US008876365B2

(12) United States Patent
Pollard et al.

(10) Patent No.: US 8,876,365 B2
(45) Date of Patent: Nov. 4, 2014

(54) MIXING SYSTEM COMPRISING AN EXTENSIONAL FLOW MIXER

(75) Inventors: Maria Pollard, Pearland, TX (US); Steven R. Strand, Midland, MI (US); David A. Eversdyk, Angleton, TX (US); Matthias Schaefer, Philippine (NL)

(73) Assignee: Dow Global Technologies LLC, Midland, MI (US)

( * ) Notice: Subject to any disclaimer, the term of this patent is extended or adjusted under 35 U.S.C. 154(b) by 0 days.

(21) Appl. No.: 13/519,152

(22) PCT Filed: Jan. 20, 2011

(86) PCT No.: PCT/US2011/021838

§ 371 (c)(1),
(2), (4) Date: Jun. 26, 2012

(87) PCT Pub. No.: WO2011/091123

PCT Pub. Date: Jul. 28, 2011

(65) Prior Publication Data

US 2012/0287744 A1 Nov. 15, 2012

Related U.S. Application Data

(63) Continuation of application No. 12/692,009, filed on Jan. 22, 2010, now abandoned.

(51) Int. Cl.
*B01F 5/06* (2006.01)

(52) U.S. Cl.
USPC ..... 366/175.2; 366/181.5; 366/338; 366/339

(58) Field of Classification Search
USPC ..... 48/189.4; 366/181.5, 337, 338, 173.1, 366/174.1, 175.2, 181.8, 182.4, 182.2, 366/163.1, 167.1, 176.1, 163.2, 336, 339; 261/79.1; 137/888–896
See application file for complete search history.

(56) References Cited

U.S. PATENT DOCUMENTS 1,861,165 A * 5/1932 Ryan ..... 106/2
2,426,833 A 9/1947 Lloyd (Continued)

FOREIGN PATENT DOCUMENTS

FR 1491215 A 8/1967
GB 1090286 A 11/1967

(Continued)

OTHER PUBLICATIONS

PCT/US2011/021838, International Search Report & Written Opinion of the International Searching Authority, May 2011.

(Continued)

*Primary Examiner* — Charles Cooley

(57) ABSTRACT

The invention provides a mixing system comprising the following:

A) at least one extensional flow mixer comprising:
a generally open and hollow body having a contoured outer surface and having:
a single entrance port and a single exit port;
a design for compressing a bulk stream, and
a design for broadening the bulk stream and the at least one injected additive stream;
B) a flow conductor; and
C) a primary additive stream injector, as described herein; and
wherein the extensional flow mixer is followed by D) a first helical static mixing element that is at least one half "flow conductor diameter ($D_1$)" downstream of the exit port of the extensional flow mixer; and
wherein the mixing system comprises at least four helical static mixing elements, placed such that the leading edge of the first helical static mixing element is located perpendicular to the main axis (major axis) of the exit port of the extensional flow mixer.

19 Claims, 22 Drawing Sheets

(56) References Cited

U.S. PATENT DOCUMENTS

| | | | | | |
|---|---|---|---|---|---|
| 3,358,749 | A | * | 12/1967 | Chisholm et al. | 165/141 |
| 3,489,208 | A | * | 1/1970 | Manteufel | 165/109.1 |
| 3,583,678 | A | * | 6/1971 | Harder | 366/340 |
| 3,632,090 | A | * | 1/1972 | White | 366/338 |
| 3,635,444 | A | * | 1/1972 | Potter | 366/339 |
| 3,860,217 | A | * | 1/1975 | Grout | 366/336 |
| 3,953,002 | A | * | 4/1976 | England et al. | 366/322 |
| 4,068,830 | A | * | 1/1978 | Gray | 366/175.2 |
| 4,183,682 | A | * | 1/1980 | Lieffers | 366/339 |
| 4,674,888 | A | * | 6/1987 | Carlson | 366/337 |
| 4,808,007 | A | | 2/1989 | King | |
| 5,484,203 | A | | 1/1996 | King et al. | |
| 5,597,236 | A | * | 1/1997 | Fasano | 366/181.5 |
| 6,132,079 | A | | 10/2000 | King | |
| 6,276,823 | B1 | * | 8/2001 | King | 366/181.5 |
| 6,279,611 | B2 | * | 8/2001 | Uematsu et al. | 137/888 |
| 6,345,907 | B1 | | 2/2002 | Akay et al. | |
| 7,138,478 | B2 | | 11/2006 | Kohlgruber et al. | |
| 7,897,121 | B1 | * | 3/2011 | Hughes et al. | 366/338 |
| 2001/0003291 | A1 | * | 6/2001 | Uematsu et al. | 137/888 |
| 2003/0048694 | A1 | | 3/2003 | Horner et al. | |
| 2003/0212207 | A1 | | 11/2003 | Weiss et al. | |
| 2006/0221763 | A1 | | 10/2006 | Reis et al. | |
| 2008/0056064 | A1 | * | 3/2008 | Tanaka | 366/339 |
| 2011/0182134 | A1 | * | 7/2011 | Pollard et al. | 366/172.2 |
| 2012/0287744 | A1 | * | 11/2012 | Pollard et al. | 366/150.1 |

FOREIGN PATENT DOCUMENTS

| | | | | | |
|---|---|---|---|---|---|
| WO | 9214541 | A1 | | 9/1992 | |
| WO | WO 9214541 | A1 | * | 9/1992 | B01F 5/06 |
| WO | 00/21650 | A1 | | 4/2000 | |
| WO | WO 00/21650 | | * | 4/2000 | B01F 5/06 |
| WO | 2002098545 | A1 | | 12/2002 | |

OTHER PUBLICATIONS

PCT/US2011/021838, International Preliminary Report on Patentability, Aug. 2012.

* cited by examiner

MIXING SYSTEM COMPRISING AN EXTENSIONAL FLOW MIXER

CROSS-REFERENCE TO RELATED APPLICATIONS

This application is a non-provisional application claiming priority from the U.S. National patent application Ser. No. 12/692,009, filed on Jan. 22, 2010, entitled "MIXING SYSTEM COMPRISING AN EXTENSIONAL FLOW MIXER" the teachings of which are incorporated by reference herein, as if reproduced in full hereinbelow.

BACKGROUND OF THE INVENTION

The present invention relates generally to static mixers, and more particularly, to an extensional flow mixer followed by helical type mixing elements, preferably also followed by of high-shear, high-pressure drop static mixing elements, that mixes two or more fluid streams flowing in a pipe.

It is often desirable to mix fluids having varied viscosities in a pipe. In a turbulent flow, mixing occurs more quickly due to induced turbulence. In a laminar flow, mixing of fluid streams is more difficult. In solution polymerization, for example, it is often desirable to mix a relatively high viscosity bulk stream, such as a polymer solution, with a relatively low viscosity liquid additive stream. Liquid additives, catalysts, liquid monomers and solvents are typically added to polymer solution to achieve other polymer products.

However, because of the high shear forces necessary to promote mixing, the high viscosity bulk stream and the low viscosity additive stream may remain essentially segregated, resulting in low rates of additive stream incorporation into the bulk stream. In a laminar flow, mixing occurs by diffusion of one stream into another, which typically is a slow process. The slow diffusion is unacceptable when a quicker mixing time is necessary for dispersion. Frequently, when the additive stream is injected into the bulk stream, the additive stream will remain substantially intact and tunnel through the bulk stream without significant interfacial mixing of the streams. This low mixing rate is due in part to the low surface area contact between the bulk stream and the additive stream. To combat such a result, it is advantageous to deform the additive stream from the cylindrical shape the additive stream initially has, to a relatively flat sheet having more surface area. It is found that deforming the additive stream by increasing its aspect ratio, the ratio of its width to its height, increases its surface area and therefore its potential interfacial mixing area. The increase in surface area also facilitates the strategy of cutting, dividing and recombining the streams in traditional static mixers. The distribution of the additive stream as a thin sheet also increases the mixing efficiency of the static mixing elements, if any, following the extensional flow mixer.

Several types of structures are known to promote mixing of a bulk stream with an additive stream, including baffle structures and shear mixers. U.S. Pat. No. 4,808,007, issued to King, discloses a dual viscosity mixer which introduces an additive stream to a bulk stream through an entry port within the mixer to create an elongated flat plane of the additive stream.

Several problems have been encountered in the field with this and other mixing structures, however. For example, in polymerization applications, polymer build-up has been observed at the contact points between the additive stream injector and the bulk stream polymer. This build-up often occurs when the additive stream is injected from within the static mixer. The polymer build-up problem compounds itself until eventually there is plugging or complete closure of the additive injector, leading to flow maldistribution in the static mixer.

Additionally, when an additive stream, such as a catalyst, contacts a baffle or other solid contact surface or wall, a wetting of the surface with the catalyst occurs, thereby decreasing the overall mixing efficiency of the catalyst with the bulk stream.

In those mixers where there are severe angular regions or step-like features, the bulk stream and the additive stream, while flowing out of such features, may develop recirculation zones and eddy currents, which decreases the overall mixing efficiency of the mixer.

Another problem is the loss of fluid pressure as the streams pass the mixer. Other dual viscosity mixers available have a relatively high pressure drop, as the streams lose fluid pressure between entering and exiting the mixer.

International Publication No. WO 00/21650 discloses an extensional flow mixer for mixing a bulk stream with an additive stream. Two extensional mixers may be arranged in series with a gap of approximately the diameter of the flow conductor to promote additional mixing capabilities. The extensional mixer may be used in laminar, transition or turbulent flow conditions.

While the prior art discloses mixers that mix bulk streams with additive streams, there exists a need for a mixing system that improves the degree of mixing of the bulk stream and the additive stream by increasing the dispersion of the additive stream within the bulk stream, which further increases the interfacial area between the two streams.

SUMMARY OF THE INVENTION

The invention provides a mixing system comprising the following:

A) at least one extensional flow mixer comprising:

a generally open and hollow body having a contoured outer surface and having:

a single entrance port and a single exit port;

a means for compressing a bulk stream flowing through the generally open and hollow body in a direction of flow, and at least one injected additive stream introduced at the single entrance port in the direction of flow; and a means for broadening the bulk stream and the at least one injected additive stream, such that an interfacial area between the bulk stream and the at least one injected additive stream is increased as the bulk stream and the at least one injected additive stream flow through the generally open and hollow body in the direction of flow to promote mixing of the bulk stream and the at least one injected additive stream;

B) a flow conductor having an axis and having a generally open and hollow flow mixer body secured therein; and C) a primary additive stream injector positioned at the entrance port of the generally open and hollow flow mixer body, wherein the primary additive stream injector injects an additive stream into the interior of the flow mixer in the direction of flow, when the bulk stream is flowing through the generally open and hollow flow mixer body, to allow for compression and broadening of the bulk stream and the additive stream together within the extensional flow mixer, to facilitate mixing of the bulk stream and the primary additive stream at an exit of the extensional flow mixer; and wherein the extensional flow mixer is followed by D) at least one helical static mixing element that is at least one half "flow conductor diameter ($D_1$)" downstream of the exit of the extensional flow mixer.

DETAILED DESCRIPTION OF THE INVENTION

Figure 1:
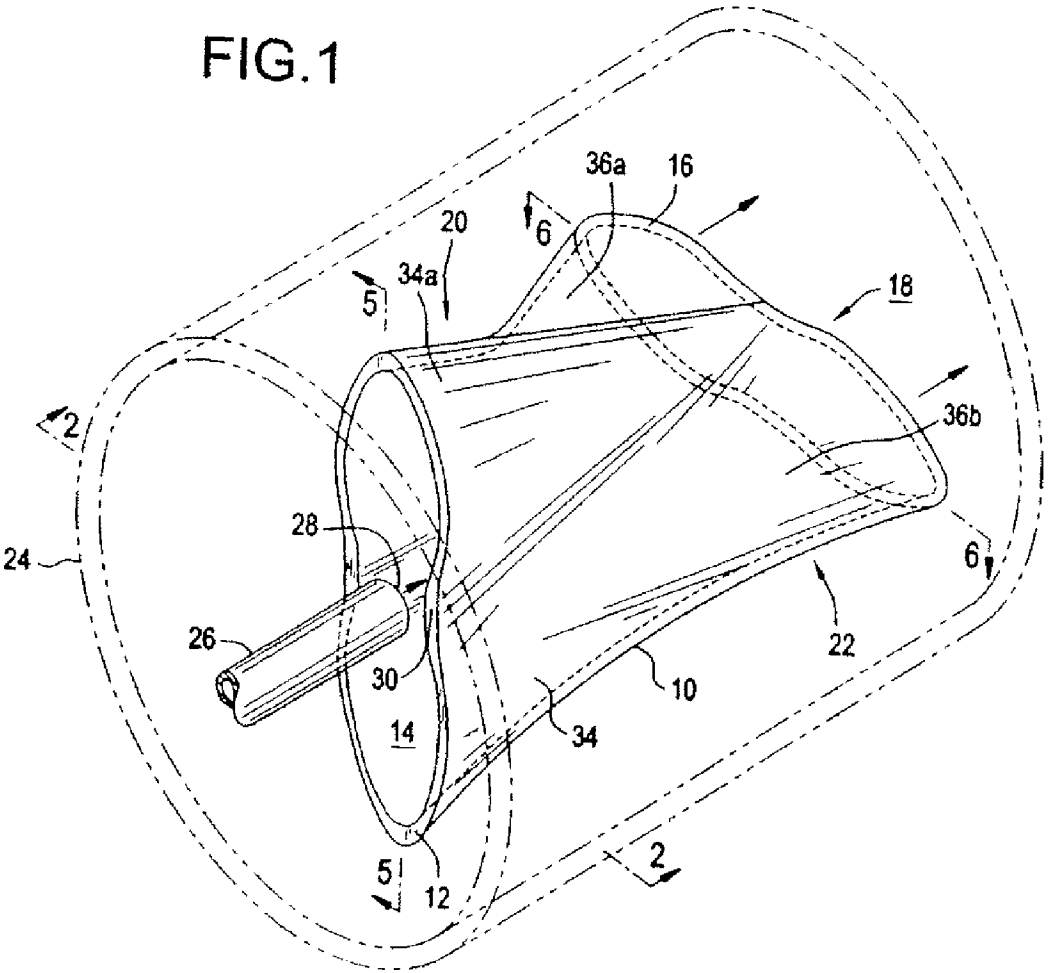
FIG. 1 is a perspective view of one embodiment of the extensional flow mixer of the present invention with a single additive stream injector.

As discussed above, the invention provides a mixing system comprising the following:

A) at least one extensional flow mixer comprising:

a generally open and hollow body having a contoured outer surface and having:

a single entrance port and a single exit port;

a means for compressing a bulk stream flowing through the generally open and hollow body in a direction of flow, and at least one injected additive stream introduced at the single entrance port in the direction of flow; and a means for broadening the bulk stream and the at least one injected additive stream, such that an interfacial area between the bulk stream and the at least one injected additive stream is increased as the bulk stream and the at least one injected additive stream flow through the generally open and hollow body in the direction of flow to promote mixing of the bulk stream and the at least one injected additive stream;

B) a flow conductor having an axis and having a generally open and hollow flow mixer body secured therein; and C) a primary additive stream injector positioned at the entrance port of the generally open and hollow flow mixer body, wherein the primary additive stream injector injects an additive stream into the interior of the flow mixer in the direction of flow, when the bulk stream is flowing through the generally open and hollow flow mixer body, to allow for compression and broadening of the bulk stream and the additive stream together within the extensional flow mixer, to facilitate mixing of the bulk stream and the primary additive stream at an exit of the extensional flow mixer; and wherein the extensional flow mixer is followed by D) at least one helical static mixing element that is at least one half "flow conductor diameter ($D_1$)" downstream of the exit of the extensional flow mixer.

Preferably, in the mixing system, the means for compressing and the means for broadening each includes a plurality of contoured lobes, each lobe having a substantially contoured surface and wherein the plurality of contoured lobes in the means for compressing decrease in size in the direction of flow, and the plurality of contoured lobes in the means for broadening increase in size in the direction of flow.

Also preferably, in the mixing system, the means for compressing lie in a compression plane, and the means for broadening lie in a broadening plane perpendicular to the compression plane.

Also preferably, in the mixing system, the means for compressing decreases in size along the compression plane in the direction of flow, and the means for broadening simultaneously increases in size along the broadening plane in the direction of flow.

Also preferably, in the mixing system, the at least one helical static mixing element is not more than four flow conductor diameters downstream of the exit of the extensional flow mixer.

Also preferably, the mixing system further comprises at least one of high-shear, high-pressure drop static mixing elements, comprising an array of crossed bars arranged at an angle of 45° against the axis, and arranged in such a way, that consecutive mixing elements are rotated by 90° around the axis, and placed downstream of the at least one helical static mixing element.

Also preferably, in the mixing system, the primary additive stream injector is positioned at the center of the entrance port.

Also preferably, in the mixing system, the primary additive stream injector is positioned along a longitudinal axis of the generally hollow flow mixer body, especially wherein the additive stream injector is further positioned at the center of the single entrance port.

Also preferably, in the mixing system, the bulk stream received by the single entrance port comprises at least one of a polymer and a polymer solution.

Also preferably, in the mixing system, the additive stream received by the single entrance port comprises at least one of a monomer and a monomer solution, more preferably wherein the monomer solution is ethylene dissolved in solvent.

Also preferably, in the mixing system, the additive stream received by the single entrance port comprises at least one of an additive or additive in solution, especially wherein the additive stream received by the single entrance port is selected from a group consisting of antioxidants, acid scavengers, catalyst kill agents and solutions thereof.

Also preferably, in the mixing system, the compression region comprises two compression region lobes that meet at a constricted central entrance portion, and the broadening region comprises two broadening region lobes that meet at a constricted central exit portion.

Also preferably, in the mixing system, the major axis of the exit (exit port) of the extensional flow mixer is perpendicular to a leading edge of the at least one helical static mixing element. The leading edge of the at least one helical static mixing element, in a series of such mixing elements, is referred to as the leading edge of the first mixing element in the series. The "leading edge" is the edge of the "helical static mixing element" that is closest to the exit port of the extensional flow mixer. Also, for example, as shown in FIG. 1, the major axis of the exit of the extensional flow mixer would fall along the 6-6 line.

In a preferred embodiment, the extensional flow mixer and the at least one helical static mixing element are located within the flow conductor.

In a preferred embodiment, all mixing elements are located within the flow conductor.

In one embodiment, the at least one helical static mixing element is located at a distance from "one half the diameter of the flow conductor (½ $D_1$)" to "twice the diameter of the flow conductor (2 $D_1$)" downstream of the exit (exit port) of the extensional flow mixer.

In one embodiment, the at least one helical static mixing element is located at a distance from "one half the diameter of the flow conductor (½ $D_1$)" to "one diameter of the flow conductor (1 $D_1$)" downstream of the exit of the extensional flow mixer.

In a preferred embodiment, the flow conductor is a cylinder.

In one embodiment, the flow conductor is a cylinder that has a length to diameter ratio ($L_1/D_1$) greater than, or equal to, 7.

In one embodiment, the flow conductor is a cylinder that has a length to diameter ratio ($L_1/D_1$) from 7 to 40.

In one embodiment, the flow conductor is a cylinder that has a length to diameter ratio ($L_1/D_1$) from 10 to 38.

In one embodiment, the mixing system comprises at least one helical static mixing element followed by at least one high-shear, high-pressure drop static mixing element.

In one embodiment, the mixing system comprises at least eight helical static mixing elements followed by at least one high-shear, high-pressure drop static mixing element.

In one embodiment, the mixing system comprises at least ten helical static mixing elements followed by at least one high-shear, high-pressure drop static mixing element.

An inventive mixing system may comprise a combination of two or more embodiments as described herein.

Various other features, objects and advantages of the present invention will be made apparent from the following detailed description and the drawings.

The drawings illustrate a preferred mode presently contemplated for carrying out the invention.

Referring to FIG. 1, an extensional flow mixer 10 is shown. Preferably this mixer is a static mixer. Flow mixer 10 has a generally open (an opening exists at each end of this mixing element) and hollow-shaped body, which terminates at one end at an edge 12 which defines the outer perimeter of an entrance port 14. Flow mixer 10 terminates at a distal end at an edge 16, shown in phantom, which defines the perimeter of the exit port 18 (exit of extensional flow mixer). Flow mixer 10 includes a compression region 20 and a broadening region 22. In the embodiment shown, the compression region is made up of two compression region lobes 34*a* and 34*b*, and the broadening region is made up of two broadening region lobes 36*a* and 36*b*. The compression region 20 lies in a compression plane that includes line 5-5 and a longitudinal axis extending from the entrance port 14 to the exit port 18. The broadening region 22 lies in a broadening plane that includes line 6-6, and is coaxial with the compression plane of the compression region 20, by sharing the longitudinal axis with the compression plane. Preferably, the compression plane of the compression region 20 is perpendicular to the broadening plane of the broadening region 22. As a result, the compression region lobes 34*a* and 34*b* are preferably positioned 90 degrees from the position of the broadening region lobes 36*a* and 36*b*. Flow mixer 10 has a generally contoured shape that can be achieved by, for example, deforming a cylinder by constricting one end of the cylinder, rotating the cylinder 90 degrees, and then constricting the other end in a similar manner.

Typically, the flow mixer 10 resides within a flow conductor 24, for example, a pipe, shown in phantom. Flow conductor 24 conducts a bulk stream, typically of a high viscosity, under laminar flow conditions. The flow mixer 10 is useful, however, at a wide range of pipe Reynolds numbers. In polymerization applications, the flow conductor 24 will conduct a polymer solution as the bulk stream. Particular polymers may include, but are not limited to, any of a number of copolymers of ethylene and 1-octene, 1-hexene, 1-butene, 4-methyl-1-pentene, styrene, propylene, 1-pentene or alpha-olefin. The flow conductor 24 introduces the bulk stream to the flow mixer 10 in a direction of flow from the entrance port 14 to the exit port 18.

It is contemplated that the utilization of the present invention in solution polymerization applications could be effected in a single loop or dual loop reactor (not shown). A suitable reactor is disclosed in PCT Application, International Publication Number WO 97/36942, entitled "Olefin Solution Polymerization", filed on Apr. 1, 1997; U.S. Provisional Applications 60/014,696 and 60/014,705, both filed on Apr. 1, 1996.

Also residing within the flow conductor 24 is a primary additive stream injector 26. The primary additive stream injector 26 is responsible for carrying an additive stream that is to be mixed with the bulk stream carried by the flow conductor 24. Typically, the additive stream is of a low viscosity and is not easily mixed. It is contemplated that many types of additives may be used. Particularly, the additive stream may include catalyst solutions, monomers, gases dissolved in solvent, antioxidants, UV stabilizers, thermal stabilizers, waxes, color dyes and pigments.

Suitable polymers, catalysts and additives contemplated by the present invention include those disclosed in U.S. Pat. No. 5,272,236; U.S. Pat. No. 5,278,272; and U.S. Pat. No. 5,665,800, all issued to Lai et al., and entitled "Elastic Substantially Linear Olefin Polymers"; and U.S. Pat. No. 5,677,383, issued to Chum et al., entitled "Fabricated Articles Made From Ethylene Polymer Blends."

In the polymerization process, the additive stream may be a catalyst solution or a monomer, such as ethylene dissolved in solvent, which is injected through an outlet 28 of the primary additive stream injector 26, positioned at the entrance port 14. In the embodiment shown, the single additive stream injector 26 is positioned, such that its additive stream injector outlet 28 is flush with the plane of the entrance port 14, and aimed at the middle of the entrance port 14. The primary additive stream injector 26 injects the additive stream in the direction of flow, without having any physical contact with the flow mixer 10. The primary additive injector 26 can be of many designs other than the tube shown, as long as it is capable of accurately delivering an additive stream.

The diameter of the additive stream injector outlet 28 should be large enough that plugging due to impurities is avoided, but preferably small enough so that the exit velocity of the stream from the primary additive stream injector 26, (that is, the jet exit velocity) is greater than, or equal to, the average bulk stream velocity.

Compression region 20 decreases in size along the compression plane in the direction of flow, as the broadening region 22 simultaneously increases in size along the broadening plane in the direction of flow. It is the simultaneous compression and broadening of the additive stream that increases the interfacial area between the bulk stream and the additive stream, thus promoting the mixing of the additive stream and the bulk stream as they are channeled through the flow mixer 10. See also, in FIG. 1, lobe 34 and entrance 30.

Figure 2:
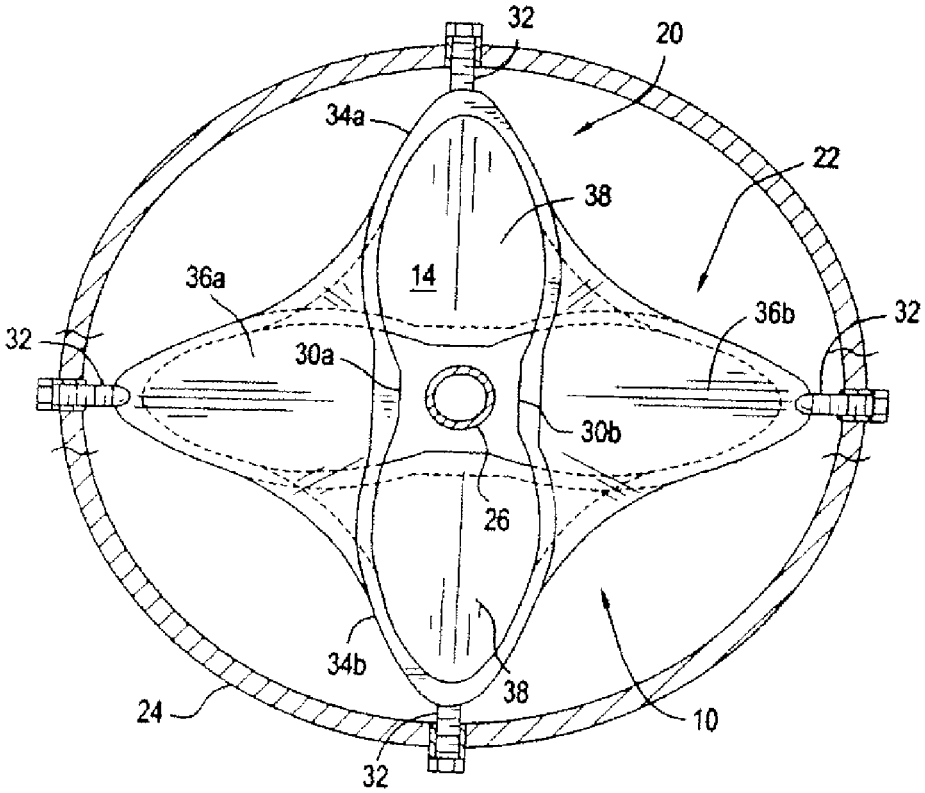
FIG. 2 is a frontal view of the extensional flow mixer, looking downstream and showing the extensional flow mixer secured within a portion of the flow conductor, taken along line 2-2 of FIG. 1.

Referring to FIG. 2, the flow mixer 10 is shown looking downstream in the direction of flow. The flow mixer 10 is suspended and secured within the flow conductor 24, in a symmetrical fashion about the center of the flow conductor 24, by any practical method. In the embodiment shown, the flow mixer 10 is secured by struts 32, such that the flow mixer 10 is substantially stable to be able to withstand the fluid pressure of the bulk stream against the flow mixer 10. The struts 32 are not required, however, as the flow mixer 10 could be glued, welded or otherwise attached to the flow conductor 24.

The primary additive stream injector 26 is preferably oriented along the longitudinal axis of the flow mixer 10, and at the center of the entrance port 14 at a midpoint of constricted central entrance portions 30*a* and 30*b*. The placement of the primary additive stream injector 26 at the center of the entrance port 14 minimizes the downstream obstructions for the additive stream. The minimization of obstructions also reduces the pressure losses of the streams, as they flow through the generally open and hollow body of the flow mixer 10.

The compression region 20 and the broadening region 22 are each comprised of a pair of lobe-shaped structures 34*a*, 34*b* and 36*a*, 36*b*, respectively. The size of the compression region lobes 34*a* and 34*b* is greatest at the entrance port 14 and generally decrease in size along the compression region 20 in the direction of flow. The broadening region lobes 36*a* and 36*b*, in contrast, are at a minimum at the entrance port 14 and generally increase along the broadening region 22 in the direction of flow.

The primary additive stream injector 26 is positioned at the entrance port 14 such that there is no obstacle to the additive stream when injected. The bulk stream flowing in flow conductor 24 and the additive stream injected by the additive stream injector 26 are channeled along the interior surface 38 of the compression region lobes 34*a* and 34*b* to become narrower in the compression region 20. The size of the lobes 34*a* and 34*b* of the compression region 20 should be the same to promote uniform compression of the streams. The compression region lobes 34 meet at the central constricted entrance portions 30*a* and 30*b*.

Figure 3:
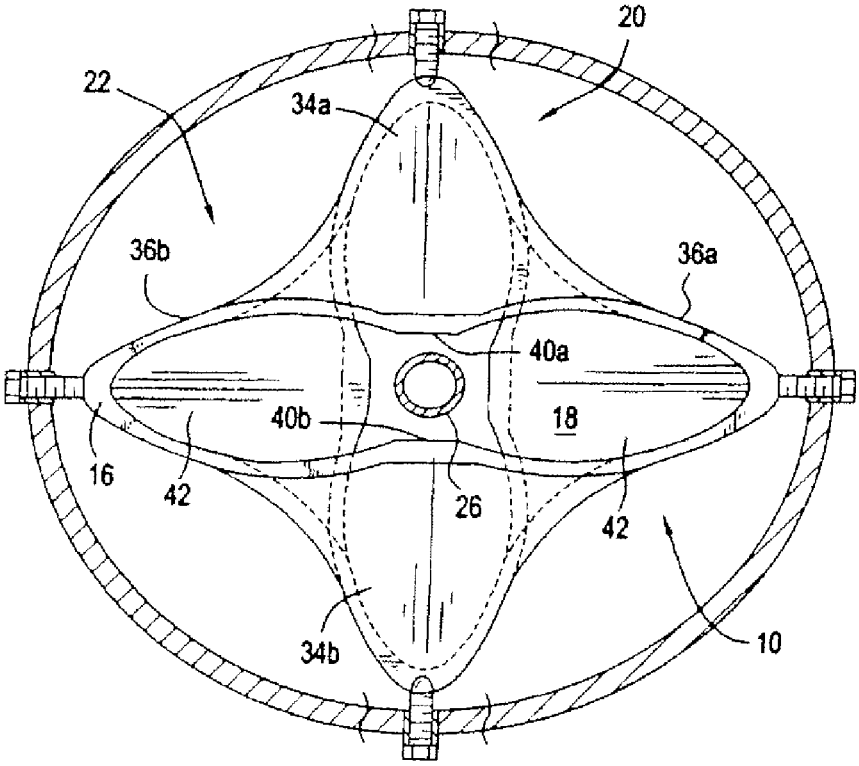
FIG. 3 is a rear view of the extensional flow mixer of FIG. 2 looking upstream.

Referring now to FIG. 3, the flow mixer 10 (see also the contour edge 16) is shown looking upstream against the direction of flow and facing the primary additive stream injector 26. The broadening region lobes 36 meet at a central constricted exit portions 40*a* and 40*b* of the exit port 18. The bulk stream and the additive stream are channeled from the compression region lobes 34*a* and 34*b* of the compression region 20 along the interior surface 42 of the broadening region lobes 36*a* and 36*b*, until the bulk stream and the additive stream reach their maximum deformation at the exit port 18. The flow patterns of the streams making the sudden but continuous transition from the compression region 20 to the broadening region 22 is sufficient to enhance the mixing of the bulk stream and the additive stream by deforming the additive stream, creating additional surface area.

The size of the exit port 18 is preferably that of the entrance port 14, but the exit port 18 should not be smaller than the entrance port 14 to avoid flow reversal inside the flow mixer 10. Additionally, the size and shape of the lobes 36*a* and 36*b* of the broadening region 22 should be the same to promote uniform broadening of the streams.

Figure 4:
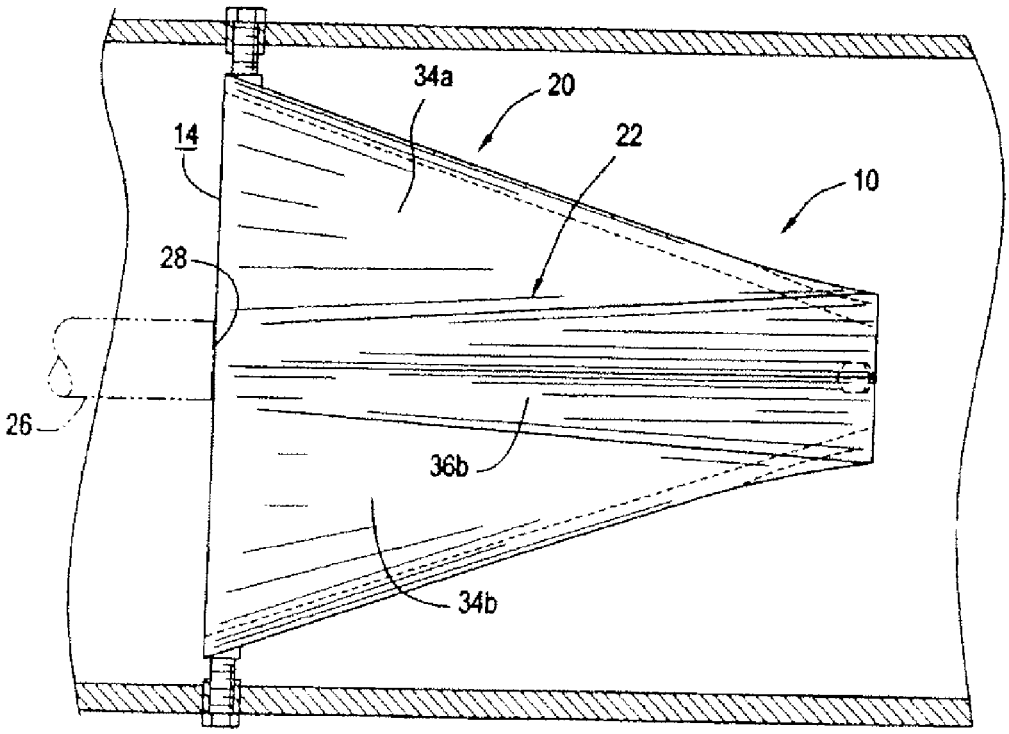
FIG. 4 is a side view of the extensional flow mixer in accordance with the present invention secured within the sectioned flow conductor.

Referring to FIG. 4, a side view of the flow mixer 10 is shown. The compression region 20 and the broadening region 22 are integrally formed. The flow mixer 10 is preferably constructed from a single piece of material. Any material that is suitable for the particular construction is contemplated by the present invention. Preferably, a material that is capable of being deformed into the compression region 20 and the broadening region 22, such as metal or polyvinyl chloride (PVC), is contemplated. The length of the flow mixer 10 is variable, although preferably it approximates the width of the flow mixer 10 at its widest point.

The primary additive stream injector 26, shown in phantom, is positioned along a longitudinal axis of the flow mixer 10. For maximum mixing enhancement, the additive stream injector 26 is preferably placed at the center, directed along the central longitudinal axis. The additive stream injector 26 is also preferably positioned such that there is no direct contact between the additive stream injector 26 and the flow mixer 10. Although the additive stream injector 26 is preferably positioned flush with the plane of the entrance port 14, the additive stream injector outlet 28 could also be mounted outside the plane of the entrance port 14, preferably by a small distance so that the additive stream will enter into the center of the flow mixer 10.

There is a continuity from the lobes 34*a* and 34*b* of the compression region 20 to the lobes 36*a* (not shown) and 36*b* of the broadening region 22 to reduce the likelihood of sharp angles and corner regions, which may cause bulk stream or additive stream build-up along the flow mixer 10. The generally hollow shape and the lack of sharp interior corners reduce the pressure losses of the bulk stream and the additive stream as they flow through the flow mixer 10.

Figure 5:
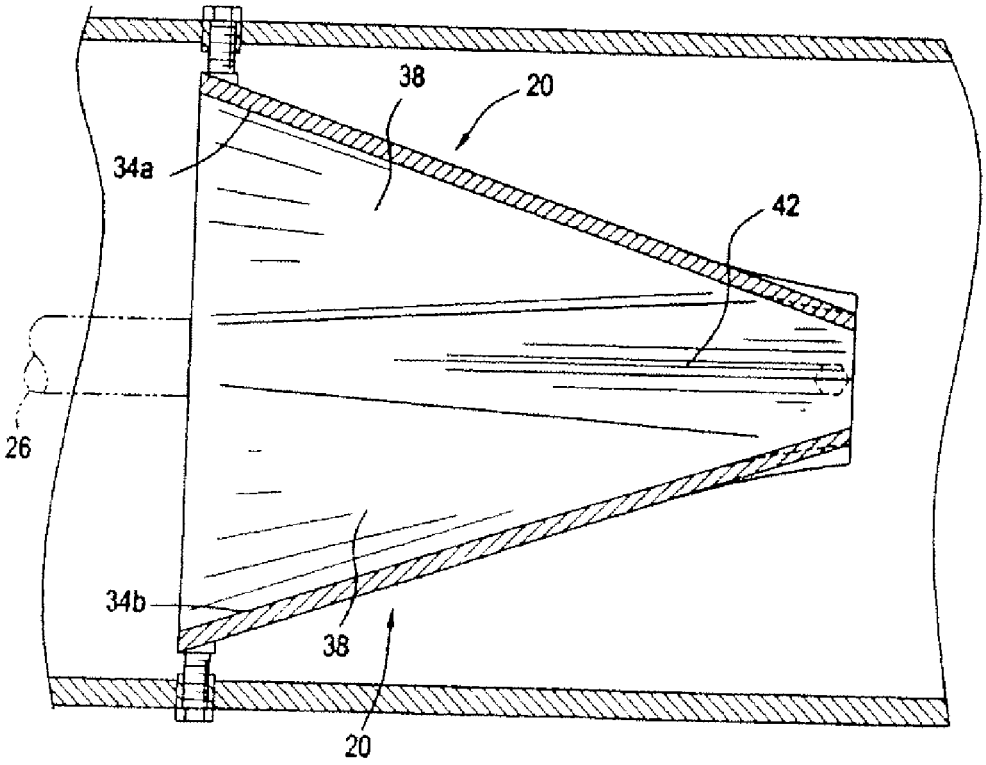
FIG. 5 is a side sectional view of the extensional flow mixer showing the compression region in accordance with the present invention, taken along line 5-5 of FIG. 1.

Referring to FIG. 5, the compression region 20, along the interior surface 42, preferably has a generally triangular shape along the compression plane. The compression region 20 decreases in the direction of flow, such that any fluid streams entering the flow mixer 10 will be narrowed in the direction of flow and channeled along the interior surface 38 of the compression region lobes 34*a* and 34*b* towards the path of the injected additive stream coming from the primary additive stream injector 26.

Figure 6:
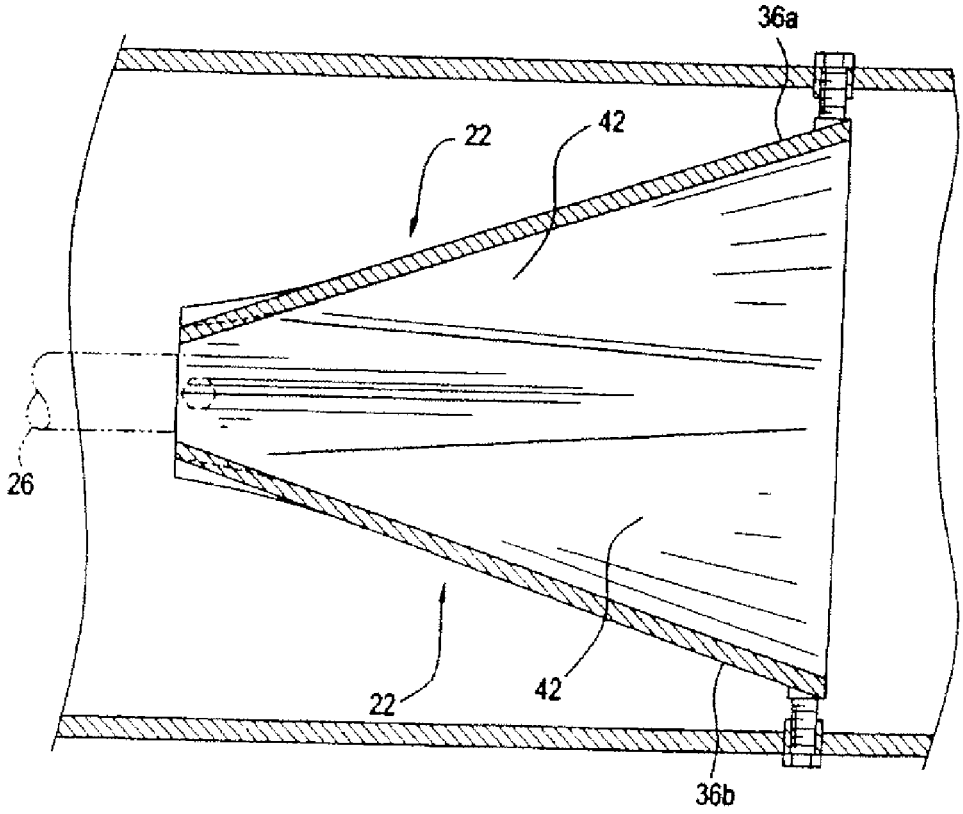
FIG. 6 is a top sectional view of the extensional flow mixer showing the broadening region in accordance with the present invention, taken along line 6-6 of FIG. 1.

Referring to FIG. 6, the broadening region 22 is also preferably generally triangular in shape along the broadening plane. The broadening region 22 increases in the direction of flow. Fluid within the broadening region 22 will be channeled along the interior surface 42 of the broadening region lobes 36*a* and 36*b*. This results in a widening of the flow within the broadening region 22. Consequently, the surface area of the additive stream from primary stream additive injector 26 is increased, thereby increasing its potential interfacial mixing area with the bulk stream.

Figure 7:
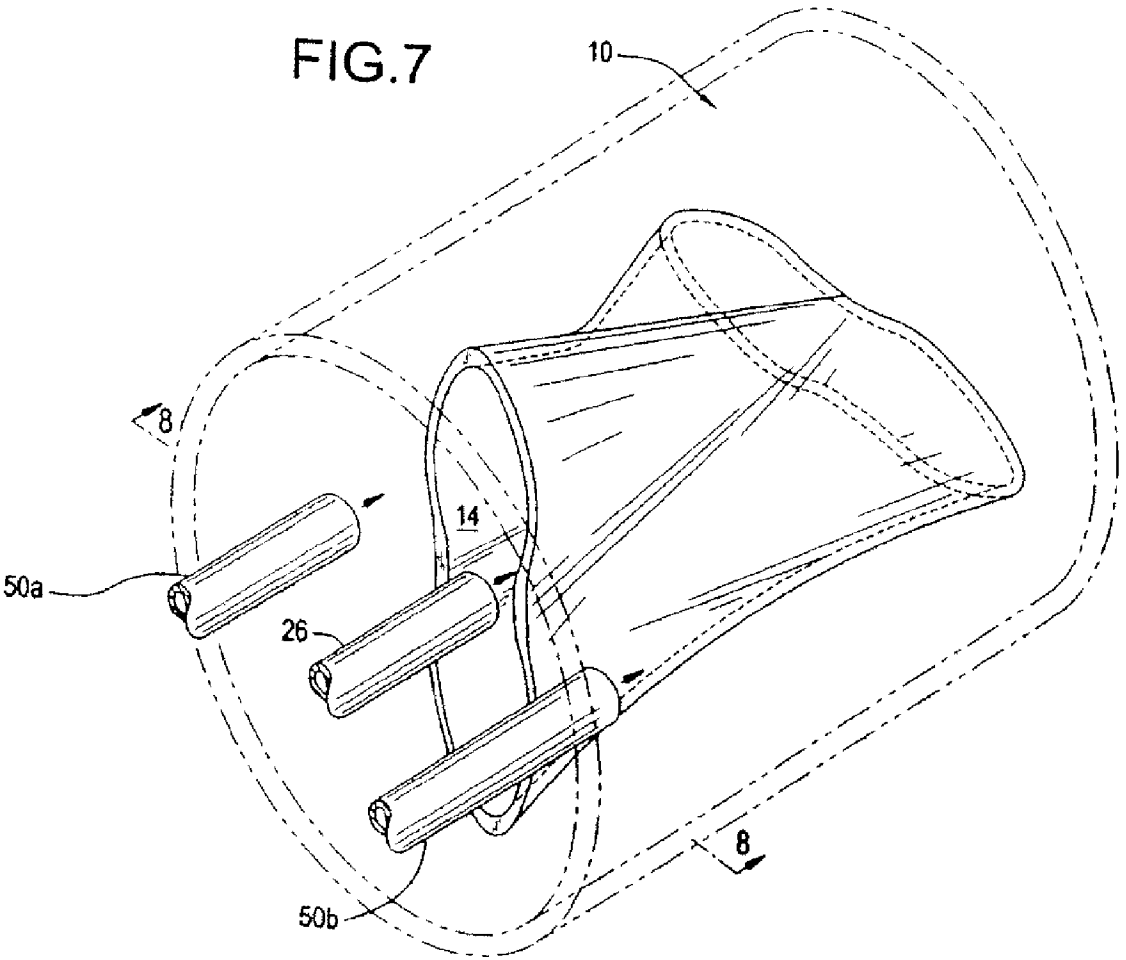
FIG. 7 is a perspective view showing the primary additive stream injector, plus a preferred location of two additional additive injection streams directed to the exterior of the extensional flow mixer in accordance with one aspect of the invention.

Referring now to FIG. 7, another embodiment of the flow mixing system is shown. In this embodiment, the bulk stream continues to flow through and around the generally open and hollow flow mixer 10. In addition to the primary additive stream injector 26 positioned at the entrance port 14, a pair of additional additive stream injectors 50*a* and 50*b* are preferably positioned flush with the plane of the entrance port 14 and aimed along the exterior of the generally open and hollow flow mixer 10. The additional additive stream injectors 50*a* and 50*b* may inject different additive streams than those injected by the primary additive stream injector 26. Preferably, the additive stream injectors 50*a* and 50*b* are positioned on either side of the primary additive stream 26. It is also contemplated that one or both of the additional additive stream injectors 50*a* and 50*b* could be used separately, or each in combination with the primary additive stream injector 26, depending on the number and type of additive streams to be incorporated into the bulk stream. A single additional additive stream injector may be used.

Figure 8:
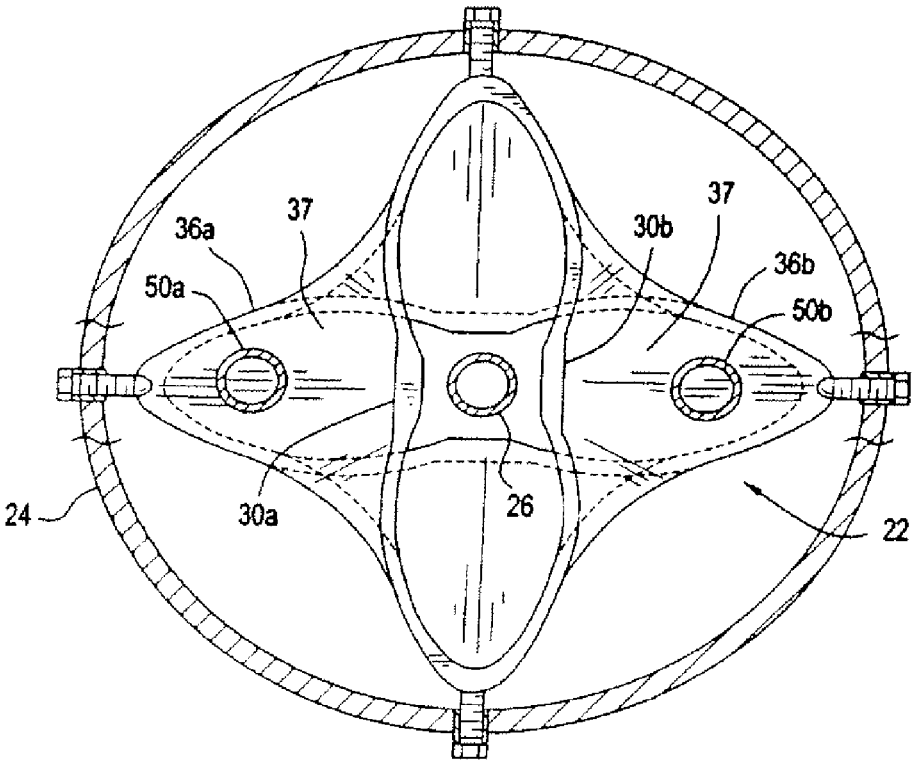
FIG. 8 is a frontal view showing the primary additive stream injector, plus a preferred position of the two additional additive stream injectors in accordance with one aspect of the invention, taken along line 8-8 of FIG. 7.

Referring to FIG. 8, the additional additive stream injectors 50*a* and 50*b* are preferably placed midway between the constricted central entrance portions 30*a* and 30*b* and the flow conductor 24, such that the additive stream injectors 50*a* and 50*b* are oriented to inject their respective additive streams into the exterior region 37 of the broadening region 22. Each additive stream injected from the additive stream injectors 50*a* and 50*b* will then deform in the exterior region 37 of the broadening region 22, causing the interfacial area between each additive stream and the bulk stream to increase, and promote the mixing of the bulk stream and the additive streams. Preferably, the additional additive stream injectors 50*a* and 50*b* inject their respective additive streams simultaneously. The additive stream injectors 50*a* and 50*b* can be positioned further from or closer to the flow mixer 10. Additional injection points may be, for example, one-third and two-thirds the distance from the central constricted entrance portions 30*a* and 30*b* to the flow conductor 24 on either side of the primary additive stream injector 26 and directed along the exterior 37 of the flow mixer 10.

Figure 9:
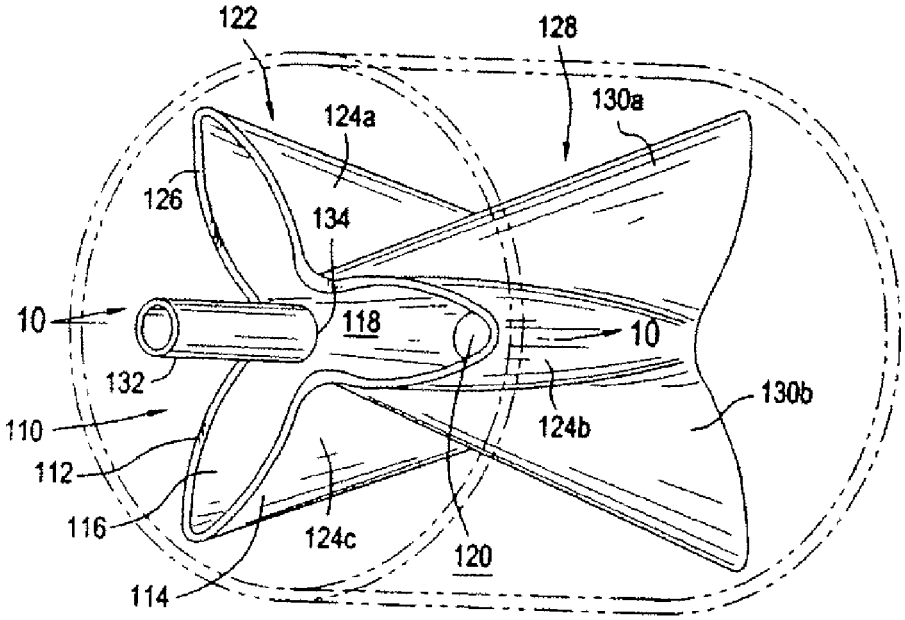
FIG. 9 is a perspective view of a three lobe per region embodiment of the present invention with the primary additive stream injector.

Referring now to FIG. 9, another embodiment of the present invention is shown. An extensional flow mixer, shown generally by the reference numeral 110, includes a generally open and hollow flow mixer body 112. The generally open and hollow flow mixer body 112 has a contoured outer surface 114 and a contoured inner surface 116 which follows the shape of the contoured outer surface 114.

The extensional flow mixer 110 includes a single entrance port 118 and a single exit port 120. A direction of flow is defined in moving from the single entrance port 118 to the single exit port 120. A leading edge 126 forms the outline of the single entrance port 118.

The generally open and hollow flow mixer body 112 includes a compression region 122. The compression region 122 includes contoured lobes 124*a*, 124*b*, and 124*c*. The contoured lobes 124*a*, 124*b* and 124*c* of the compression region 122 decrease in size in the direction of flow from the leading edge 126 of the single entrance port 118 to the single exit port 120. The generally open and hollow flow mixer body 112 also includes a broadening region 128. The broadening region 128 similarly includes contoured lobes 130*a*, 130*b* and 130*c* (not shown). The contoured lobes 130*a*, 130*b* and 130*c* in the broadening region 128 increase in size in the direction of flow when going from the single entrance port 118 to the single exit port 120. The contoured lobes 124*a*, 124*b* and 124*c* of the compression region 122 alternate with the contoured lobes 130*a*, 130*b* and 130*c* of the broadening region 128 around the contoured outer surface 114 of the generally open and hollow flow mixer body 112.

A primary additive stream injector 132 is positioned at the single entrance port 118 such that the outlet 134 of the primary additive stream injector 132 is positioned at the center of and flush with the single entrance port 118.

Figure 10:
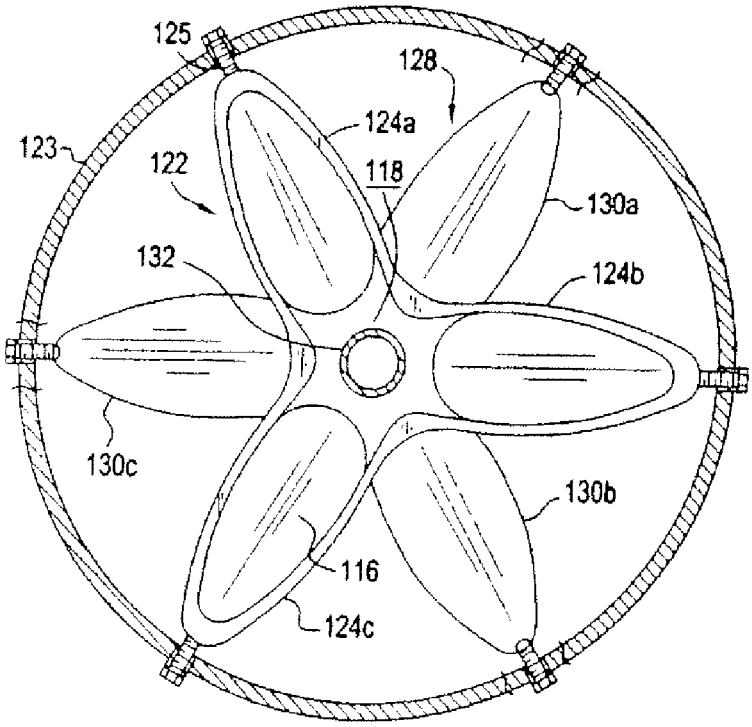
FIG. 10 is a frontal view of the three lobe per region embodiment of the present invention looking downstream, taken along line 10-10 of FIG. 9.

Referring now to FIG. 10, the size and shape of the contoured lobes 124*a*, 124*b* and 124*c* of the compression region 122 are preferably the same as the size and shape of the contoured lobes 130*a*, 130*b* and 130*c* of the broadening region 128.

The primary additive stream injector 132 is preferably positioned so as to inject a primary additive stream through the interior of the generally open and hollow flow mixer body 112 without encountering any obstacles.

In operation, the bulk stream flowing through the generally open and hollow flow mixer body 112 will compress in the compression region 122 and thereby compress the primary additive stream and increase its interfacial mixing area.

The bulk stream enters the single entrance port 118 and is compressed by the contoured inner surface 116 of each of the contoured lobes.

The extensional flow mixer 110 is attached to a flow conductor 123, typically a cylinder, preferably by way of struts 125, although any suitable attachment method is acceptable.

Figure 11:
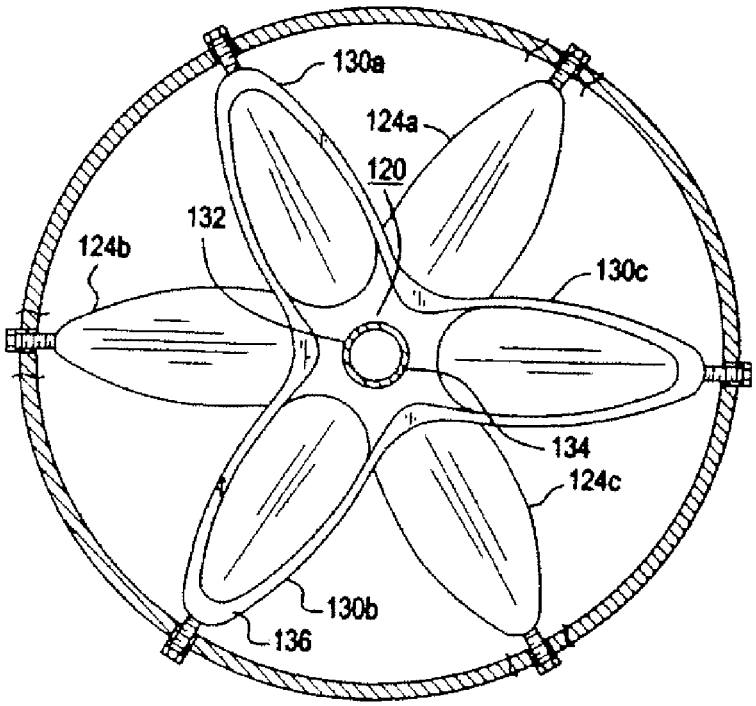
FIG. 11 is a rear view of the three lobe per region embodiment of FIG. 9 looking upstream.

Referring now to FIG. 11, the outlet 134 of the primary additive stream injector 132 is visible from the single exit port 120. The single exit port 120 is preferably the same size, but not smaller than, the single entrance port 118. The contoured lobes 130*a*, 130*b* and 130*c* of the broadening region 128 are at their maximum and terminate at a trailing edge 136 which defines the outer perimeter of the single exit port 120. See also contoured lobes 124*a*, 124*b* and 124*c*.

Figure 12:
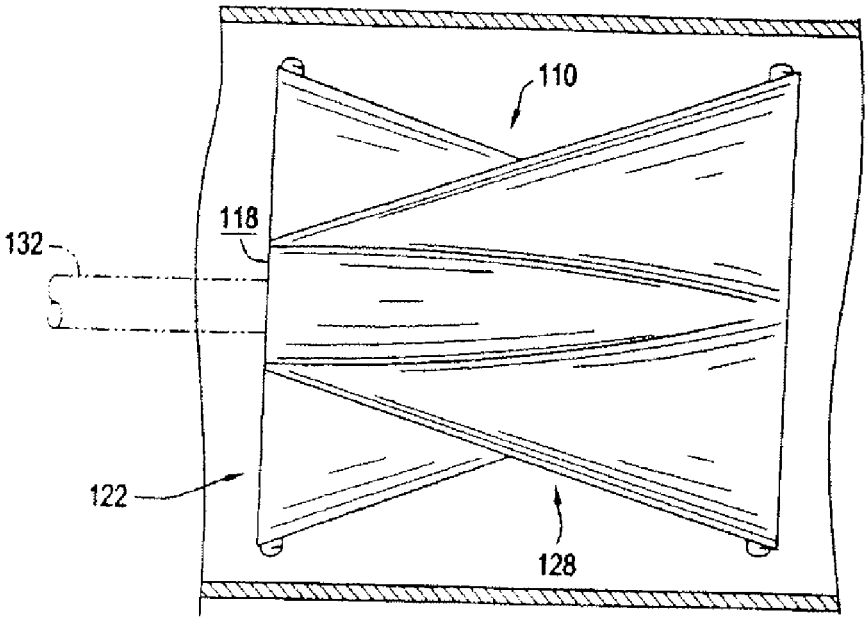
FIG. 12 is a side view of the three lobe embodiment of the present invention in FIG. 9.

Referring to FIG. 12, a side view of the extensional flow mixer 110 shows that the primary additive stream injector is positioned along the longitudinal axis of the extensional flow mixer 110. Preferably, the primary additive stream injector 132 is flush with the plane of the single entrance port 118.

The compression region 122 decreases in size in the direction of flow, while the broadening region 128 increases in size in the direction of flow. It is the simultaneous converging of the compression region 122 and the diverging of the broadening region 128 that causes the increase in interfacial area between the bulk stream and any additive streams injected by the primary additive stream injector 132.

Figure 13:
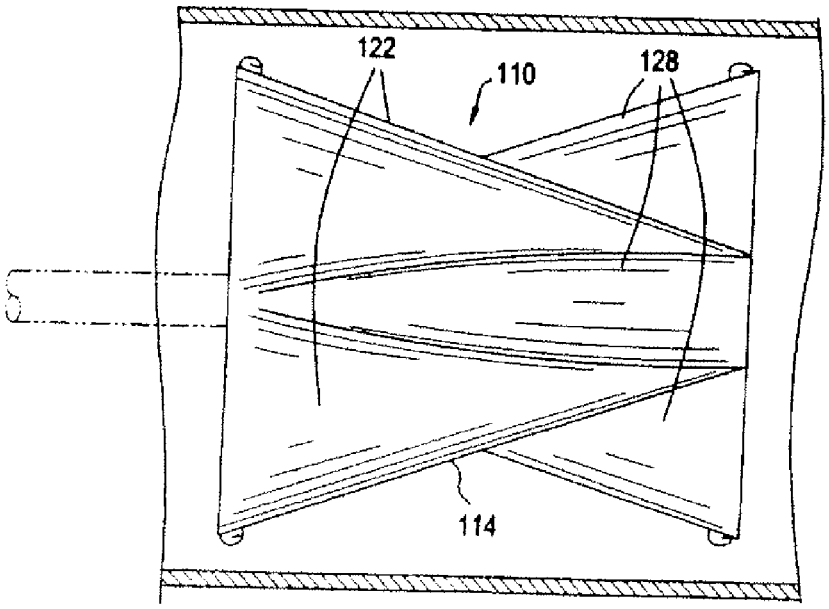
FIG. 13 is a plan view showing the three lobe per region embodiment of the present invention, taken 60 degrees above FIG. 12.

Referring now to FIG. 13, the compression region 122 is integrally formed with the broadening region 128, such that the contoured outer surface 114 does not contain any severe angular regions or step-like features that may decrease the overall mixing efficiency of the extensional flow mixer 110.

Figure 14:
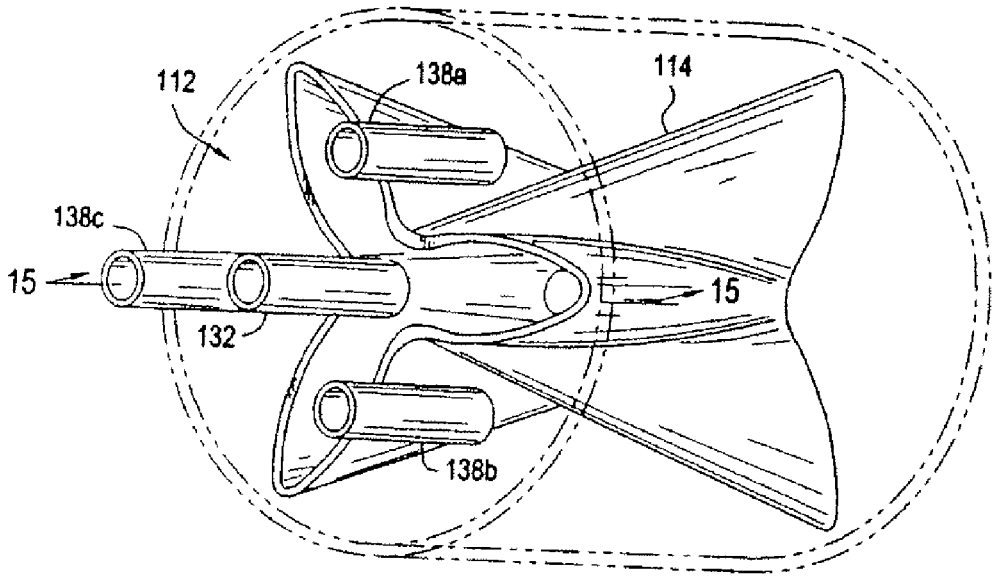
FIG. 14 is a perspective view of the three lobe per region embodiment of the present invention with the primary additive stream injector and the preferred locations of the additional additive stream injectors.

Referring now to FIG. 14, additional additive stream injectors 138*a*, 138*b*, and 138*c* may be oriented such that they are aimed toward the contoured outer surface 114 of the generally open and hollow flow mixer body 112. See also injector 32.

Figure 15:
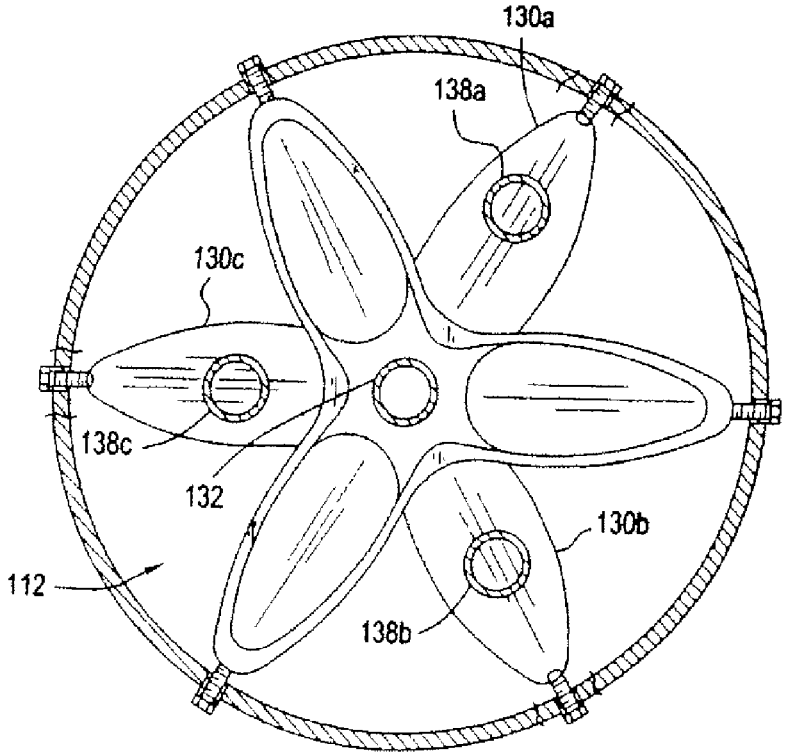
FIG. 15 is a frontal view of the three lobe per region embodiment of the present invention looking downstream, taken along line 15-15 of FIG. 14.

Referring now to FIG. 15, the preferred locations of the additional additive stream injectors 138*a*, 138*b* and 138*c* are shown. Preferably, the additional additive stream injectors 138*a*, 138*b* and 138*c* are directed towards the exterior of each of the contoured lobes 130*a*, 130*b* and 130*c* of the broadening region 128. It is understood that fewer additional additive streams may be utilized in conjunction with the primary additive stream injector 132. It is important to note that again, there is no direct contact between neither the primary additive stream injector 132 nor the additional additive stream injectors 138*a*, 138*b* and 138*c* with the generally open and hollow flow mixer body 112. The absence of direct contact reduces the likelihood of additive build-up and fouling on the flow mixer body 112 during operation.

Figure 16:
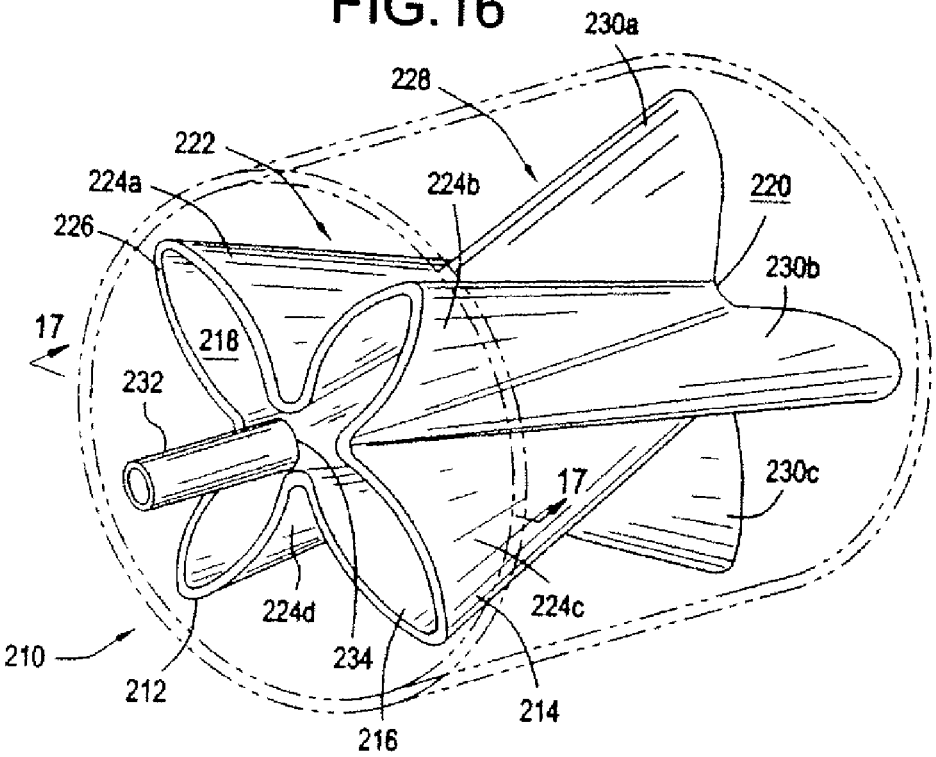
FIG. 16 is a perspective view of a four lobe per region embodiment of the present invention with the primary additive stream injector.

Referring now to FIG. 16, another embodiment of the present invention is shown. An extensional flow mixer, shown generally by the reference numeral 210, includes a generally open and hollow flow mixer body 212. The generally open and hollow flow mixer body 212 has a contoured outer surface 214 and a contoured inner surface 216 which follows the shape of the contoured outer surface 214.

The extensional flow mixer 210 includes a single entrance port 218 and a single exit port 220. A direction of flow is defined in moving from the single entrance port 218 to the single exit port 220.

The generally open and hollow flow mixer body 212 includes a compression region 222. The compression region 222 includes contoured lobes 224*a*, 224*b*, 224*c* and 224*d*. The contoured lobes 224*a*, 224*b*, 224*c* and 224*d* of the compression region 222 decrease in size in the direction of flow from the leading edge 226 of the single entrance port 218 to the single exit port 220. The leading edge 226 forms the outline of the single entrance port 218. The generally open and hollow flow mixer body 212 also includes a broadening region 228. The broadening region 228 similarly includes contoured lobes 230*a*, 230*b*, 230*c* and 230*d* (not shown). The contoured lobes 230*a*, 230*b*, 230*c* 230*d* in the broadening region 228 increase in size in the direction of flow when going from the single entrance port 218 to the single exit port 220. The contoured lobes 224*a*, 224*b*, 224*c* and 224*d* of the compression region 222 alternate with the contoured lobes 230*a*, 230*b*, 230*c* and 230*d* of the broadening region 228 around the contoured outer surface 214 of the generally open and hollow flow mixer body 212.

A primary additive stream injector 232 is preferably positioned at the single entrance port 218, such that the outlet 234 of the primary additive stream injector 232 is positioned at the center of, and flush with, the single entrance port 218.

Figure 17:
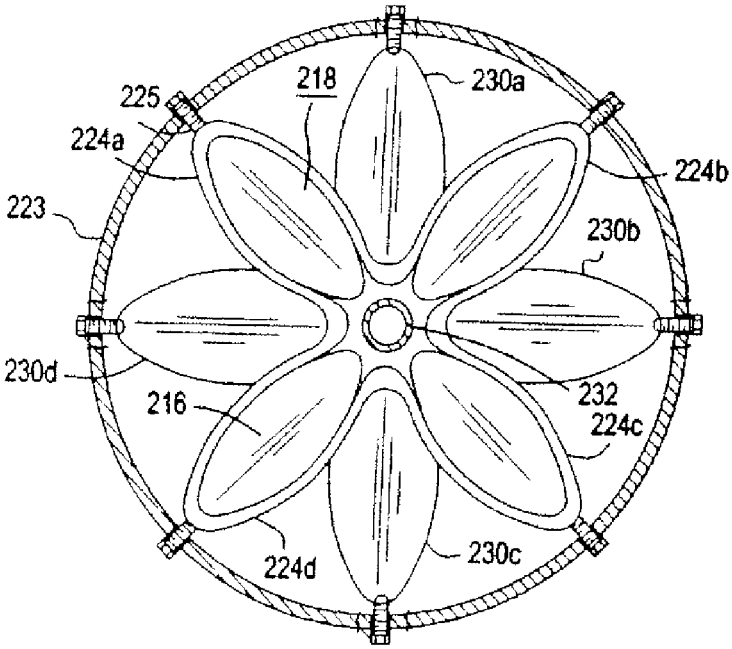
FIG. 17 is a frontal view of the four lobe per region embodiment of the present invention looking downstream, taken along line 17-17 of FIG. 16.

Referring now to FIG. 17, the size and shape of the contoured lobes 224*a*, 224*b*, 224*c* and 224*d* of the compression region 222 are preferably the same as the size and shape of the contoured lobes 230*a*, 230*b*, 230*c* and 230*d* of the broadening region 228.

The primary additive stream injector 232 is preferably positioned so as to inject a primary additive stream through the interior of the generally open and hollow flow mixer body 212 without encountering any obstacles.

In operation, similarly to the other embodiments, the bulk stream flowing through the generally open and hollow flow mixer body 212 will compress in the compression region 222, and thereby compress the primary additive stream and increase its interfacial mixing area.

The bulk stream enters the single entrance port 218 and is compressed by the contoured inner surface 216 of each of the contoured lobes.

The extensional flow mixer 210 is attached to a flow conductor 223, typically a cylinder, preferably by way of struts 225, although any suitable mode of attachment is acceptable.

Figure 18:
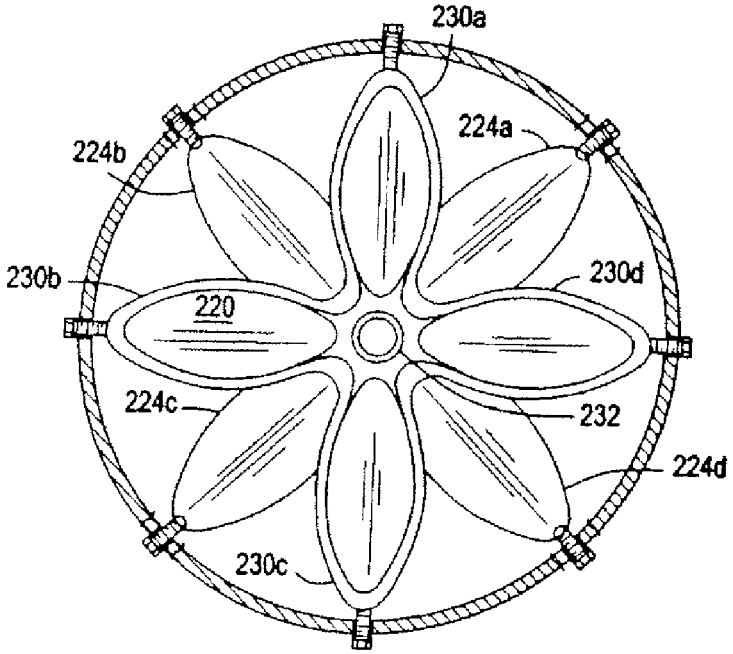
FIG. 18 is a rear view of the four lobe per region embodiment of FIG. 16 looking upstream.

Referring now to FIG. 18, the outlet 234 of the primary additive stream injector 232 is visible from the single exit port 220. The single exit port 220 is preferably the same size, but not smaller than, the single entrance port 218. The contoured lobes 230*a*, 230*b*, 230*c* and 230*d* of the broadening region 228 are at their maximum and terminate at the trailing edge 236 which defines the outer perimeter of the single exit port 220. See also contoured lobes 224*a*, 224*b*, 224*c* and 224*d*.

Figure 19:
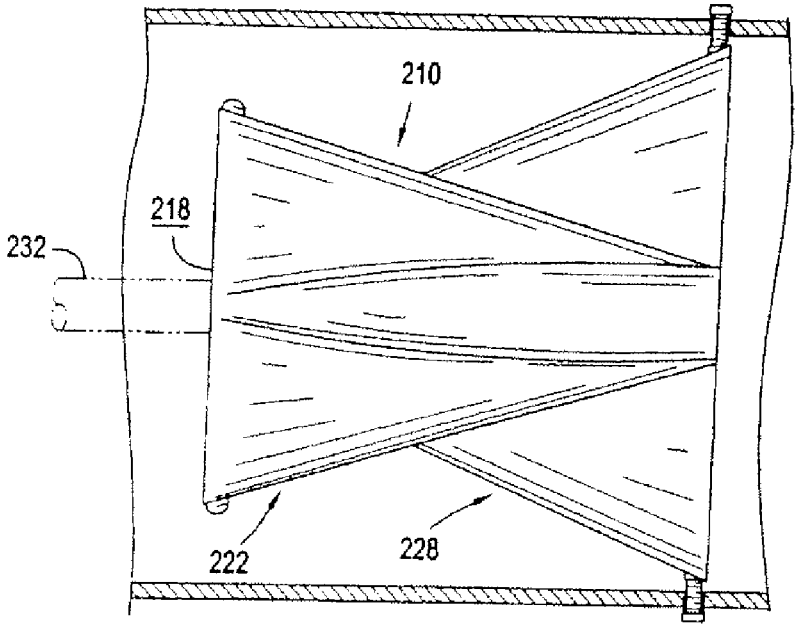
FIG. 19 is a side view of the four lobe per region embodiment of the present invention in FIG. 16.

Referring to FIG. 19, a side view of the extensional flow mixer 210 shows that the primary additive stream injector 232 is positioned along the longitudinal axis of the extensional flow mixer 210. Preferably, the primary additive stream injector 232 is flush with the plane of the single entrance port 218.

The compression region 222 decreases in size in the direction of flow, while the broadening region 228 increases in size in the direction of flow. It is the simultaneous converging of the compression region 222 and the diverging of the broadening region 228 that causes the increase in interfacial area between the bulk stream and any additive streams injected by the primary additive stream injector 232.

Figure 20:
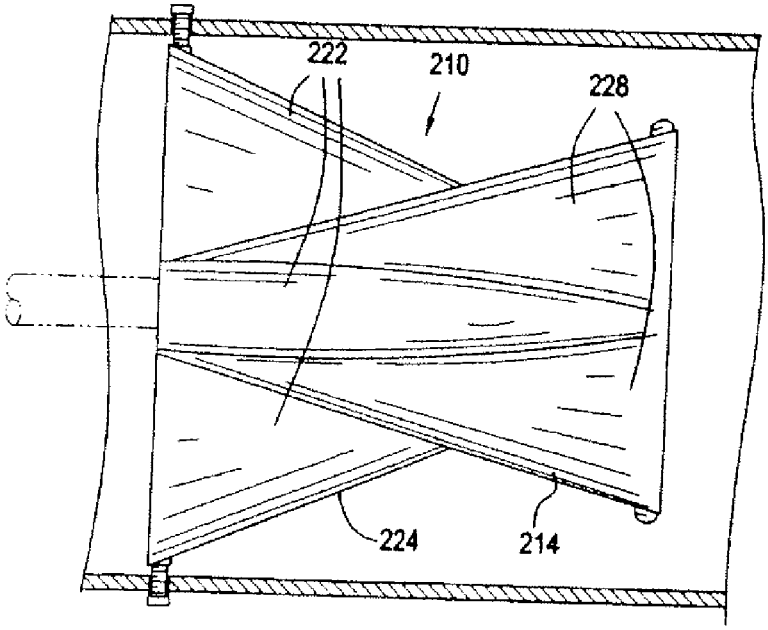
FIG. 20 is a plan view showing the four lobe per region embodiment of the present invention, taken 45 degrees above FIG. 19.

Referring now to FIG. 20, the compression region 222 is integrally formed with the broadening region 228, such that the contoured outer surface 214 does not contain any severe angular regions or step-like features that may decrease the overall mixing efficiency of the extensional flow mixer 210. See also outer surface of contoured lobe 224.

Figure 21:
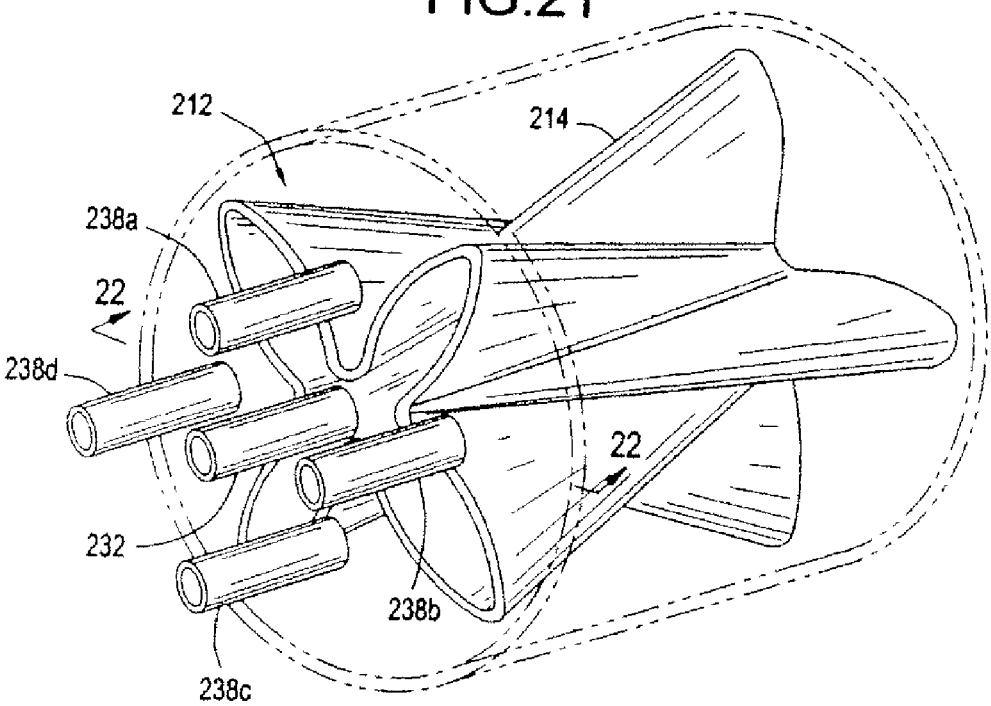
FIG. 21 is a perspective view of the four lobe per region embodiment of the present invention with the primary additive stream injector and the preferred locations of the additional additive stream injectors.

Referring now to FIG. 21, additional additive stream injectors 238*a*, 238*b*, 238*c* and 238*d* are oriented such that they are aimed toward the contoured outer surface 214 of the generally open and hollow flow mixer body 212. See also additive stream injector 232.

Figure 22:
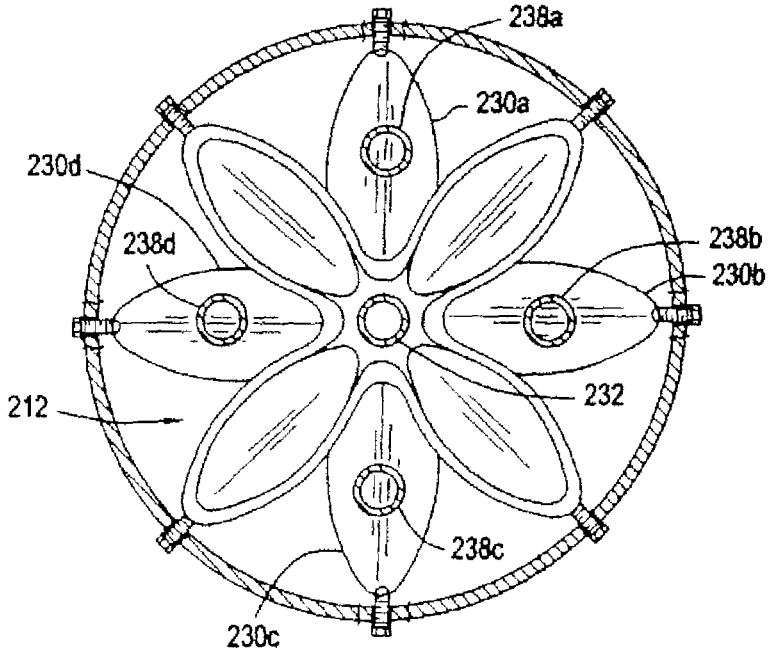
FIG. 22 is a frontal view of the four lobe per region embodiment of the present invention looking downstream, taken along line 22-22 of FIG. 21.

Referring now to FIG. 22, the preferred locations of the additional additive stream injectors 238*a*, 238*b*, 238*c* and 238*d* are shown. Preferably, the additional additive stream injectors 238*a*, 238*b*, 238*c* and 238*d* are directed towards the exterior of each of the contoured lobes 230*a*, 230*b*, 230*c* and 230*d* of the broadening region 228. It is understood that fewer additional additive stream injectors may be utilized in conjunction with the primary additive stream injector 232. There is no direct contact between neither the primary additive stream injector 232 nor the additional additive stream injectors 238*a*, 238*b*, 238*c* and 238*d* with the generally open and hollow flow mixer body 212. The absence of direct contact reduces the likelihood of fouling of the flow mixer during operation.

The method of the present invention is directed to mixing an additive stream with a bulk stream. It is important to note that the method contemplated by the present invention is independent of the sequence of the particular bulk stream and additive streams entering the flow mixer, and is also independent of the relative concentrations of the bulk stream with respect to the primary and additional additive streams. Additionally, many types of bulk streams and additive streams heretofore mentioned are contemplated by the present method. Particularly, additives such as catalysts, monomers, pigments, dyes, anti-oxidants, stabilizers, waxes, and modifiers are added to bulk streams including various polymer and co-polymer melts, solutions and other viscous liquids.

In accordance with the method, the generally open and hollow flow mixer is provided as heretofore described. An additive stream is injected into the single entrance port of the generally open and hollow flow mixer body. The additive stream and the bulk stream are compressed in the compression region and broadened in the broadening region to increase the interfacial area between the bulk stream and the additive stream to promote mixing of the bulk and the additive stream. The compressing and broadening steps preferably occur simultaneously.

In another aspect of the method, at least one additional additive injector is utilized along with at least one primary additive stream injector, by injecting at least one additional additive stream into the region exterior to the generally hollow flow mixer body, resulting in deformation of each of the additional additive streams in the exterior region of the generally hollow flow mixer body. The additional additive streams are shaped into curved sheets by the bulk flow field created by the exterior of the generally hollow flow mixer body. It can be appreciated that there are many combinations of primary and additive stream injectors which inject their streams both internally and externally to the generally hollow flow mixer body.

The present invention has been described in terms of the preferred embodiment, and it is recognized that equivalents, alternatives, and modifications, aside from those expressly stated, are possible and within the scope of the appending claims.

For example, it is contemplated that more than four lobes per region may be used. A multiple lobe structure having additional lobes per region may be used to mix more additives with the bulk stream. Other quantities and combinations of primary and additive stream injectors, arranged in a variety of configurations, both inside and outside the flow mixer body, are contemplated. Additionally, two extensional flow mixers may be arranged in series with a gap of approximately the diameter of the flow conductor 24 to promote additional mixing capabilities. The extensional flow mixer 10 may be used to mix, in addition to liquids, a gas with a gas, a gas with a liquid, or an immiscible liquid with a liquid. Finally, the extensional flow mixer 10 may be used in laminar, transition or turbulent flow conditions.

Figure 29:
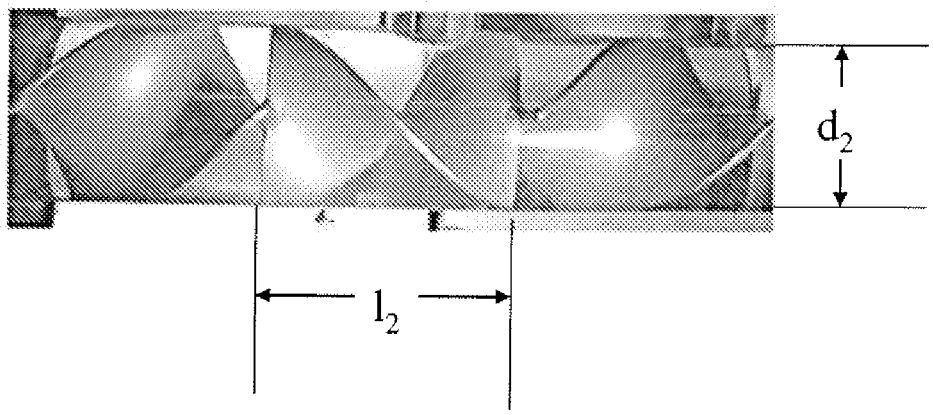
FIG. 29 depicts three helical type static mixing elements (for example, Kenics static mixing elements by Chemineer, Inc.) and defines the diameter, $d_2$, and length, $l_2$, of an element.

In another embodiment, the extensional flow mixer is followed by one or more helical type mixing elements (for example, see FIG. 29). As shown in FIG. 29, the example helical type mixer comprises three mixing elements each represented by a rectangular plate that is twisted along its longitudinal axis. The length, $l_2$, represents the length of the twisted plate and the diameter, $d_2$ is the width of the twisted plate. The degree of twist is typically from 120 to 210 degrees, and preferably from 160 to 180 degrees. The degree of twist is along the longitudinal axis of the rectangular plate. The "leading edge of the first helical type static mixing element, in a series of such mixing elements, in the direction of bulk flow," is referred to as the leading edge of the first mixing element.

Figure 30:
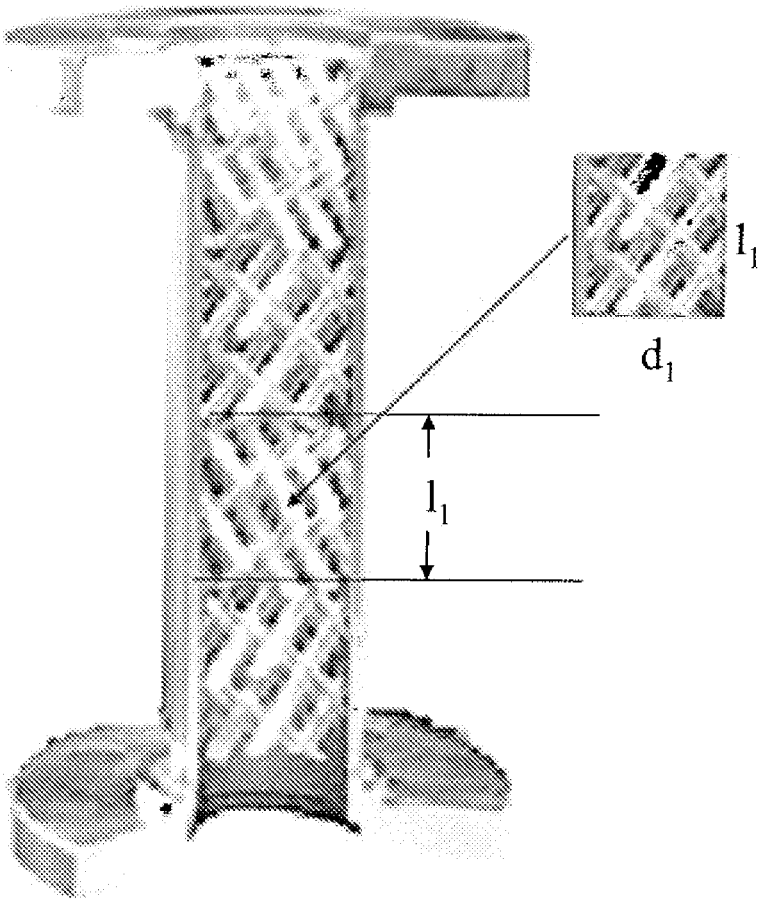
FIG. 30 depicts four high-shear, high-pressure drop mixing elements consisting of an array of crossed bars arranged at an angle of 45° against the tube axis (for example, SMX static mixing elements Chemineer, Inc.) and defines the diameter, $d_2$, and length, $l_2$, of an element.

In one embodiment, the helical type static mixing elements are followed by high-shear, high-pressure drop mixing elements consisting of an array of crossed bars arranged at an angle of 45° against the tube axis (for example, see FIG. 30). FIG. 30 shows four such mixing elements of the same dimensions, arranged so the one element is rotated at 90 degrees when compared to the mixing element adjacent to it along the longitudinal axis. The length, $l_2$, represents the length of the array of cross bars and the diameter, $d_2$ is the width of the array of cross bars.

The helical type and high-shear, high pressure drop mixing elements can be placed between a gear pump and a screen pack, preferably also followed by a pelletizer, where a side arm extruder may feed an additive concentrate between the gear pump and the extensional flow mixer in a polymerization process, especially an ethylene polymerization process, and at a rate relative to the main process stream of 0.1 up to 30 weight percent.

Representative examples of helical type mixing elements are the Kenics type static mixing elements by Chemineer, Inc. Helical type mixing elements are also produced by Ross Koflo Corporation and StaMixCo. Helical static mixing elements are also referred to as "helical twisted tapes". Representative examples of the high-shear, high-pressure drop mixing elements are the SMX type static mixing elements by Chemineer, Inc.

High-shear and high-pressure drop mixing elements are such that they induce a shear rate that is two to three times higher than the helical type mixing elements, and a pressure drop that is at least six times higher than the helical type mixing elements.

In one embodiment, the at least one helical static mixing element is located at a distance from "one half the diameter of the flow conductor (½ $D_1$)" to "twice the diameter of the flow conductor (2 $D_1$)" downstream of the exit of the extensional flow mixer.

In one embodiment, the at least one helical static mixing element is located at a distance from "one half the diameter of the flow conductor (½ $D_1$)" to "the diameter of the flow conductor (1 $D_1$)" downstream of the exit of the extensional flow mixer.

In one embodiment, the at least one helical static mixing element is placed in such a way so that the major axis of the exit of the extensional flow mixer is at 90 degrees with the leading edge of the helical static mixing element.

In one embodiment, the additive stream is injected coaxially with the main flow and at the center of the extensional flow mixer.

In one embodiment, the coaxial injector is located at a distance from "at least 0.1 diameter of the flow conductor (0.1 $D_1$)" to "one diameter of the flow conductor (1 $D_1$)" from the inlet of the extensional flow mixer.

In one embodiment, the flow conductor is a cylinder that has a length to diameter ratio ($L_1/D_1$) greater than, or equal to, 7.

In one embodiment, the flow conductor is a cylinder that has a length to diameter ratio ($L_1/D_1$) from 7 to 40.

In one embodiment, the flow conductor is a cylinder that has a length to diameter ratio ($L_1/D_1$) from 10 to 38.

In one embodiment, the mixing system comprises at least four helical static mixing elements placed such that the leading edge of the first helical static mixing element is located perpendicular to the main axis (major axis) of the exit of the extensional flow conductor.

In one embodiment, the system comprises at least one helical static mixing element followed by at least one high-shear, high-pressure drop static mixing element.

In one embodiment, the system comprises at least eight helical static mixing elements followed by at least one high-shear, high-pressure drop static mixing element.

In one embodiment, the system comprises at least ten helical static mixing elements followed by at least one high-shear, high-pressure drop static mixing element.

An inventive mixing system may comprise a combination of two or more embodiments as described herein.

Although the invention is especially useful for mixing and blending polymers and polymer solutions, other applications include, but are not limited to, food preparations and paint blends.

For example, polymer and polymer solutions can be blended when they have similar viscosities and similar flow rates, but this mixing system is most effective when both the viscosity ratios and the flow rate ratios are not close to unity. For example, in one application, the viscosity ratios range from 300:1 to 6,100:1 for the main (bulk): additive streams, and the corresponding flow ratio can range from 300:1 to 600:1 for the same two streams. In another application, the viscosity ratio can be in the range of 100:1 for the bulk: additive streams to 1:100 for the two streams, i.e., the additive stream can have higher or lower viscosity than the bulk stream. In addition, typical flow rate ratios can range from 70:30 to 98:2 by weight for the bulk: additive streams. Even when the extensional flow mixer is used, the best mixing is achieved when the viscosity and flow rate ratios are close to unity.

We have also discovered that problems can occur if the extensional flow mixer and the downstream mixer are not aligned correctly with each other. For example, if the additive stream is colder than the bulk stream, and the extensional flow mixer outlet is aligned directly with the leading edge of the helical type mixing element, impingement on the element can cause sufficient cooling to possibly freeze, foul or precipitate polymer. We now believe that the extensional flow mixer is most effective if the outlet "flow sheet" of our invention is perpendicular in alignment to the leading edge of the first downstream element of the helical type mixing element.

We have also discovered that the extensional flow mixer, together with the helical type mixing elements, demonstrate much more improvement in laminar pipe flow blending systems, than in a well mixed loop reactor, which had nearly continuous stirred tank reactor mixing. Thus, this invention is especially useful for the mixing of catalyst neutralization agents or additives in pipe flow, after the reactor, and for the mixing of two polymer melt streams, such as in sidearm extruder blending in polyethylene processes.

We have also discovered that the position and shape of the injected stream before the extensional flow mixer is important to the performance of the device. Computational Fluid Dynamics studies have shown that performance is improved if the spacing between the injection nozzle and the extensional flow mixer is sufficient to allow the injection stream diameter to equilibrate with the surrounding flow, which can take place within one to five inches.

The extensional flow mixer used alone should be modified for a given application by increasing the central opening size at the point of injection, so that the equilibrated diameter of the additive stream is slightly smaller than the inner walls of the extensional flow mixer device. The equilibrated additive stream diameter can be calculated based on the volumetric ratio of the main stream to that of the additive stream, based on a simple mass balance.

We have discovered that the extensional flow mixer is effective for mixing fluids, in which the main stream viscosity can be either higher or lower than that of the additive stream.

In another application, this mixing system can be applied to the addition of catalyst neutralization agents and antioxidants into the polyethylene solution process downstream of the reactor, where the aim is to hydrolyze the catalyst and neutralize the acid that is formed. It is not easy to measure mixing on line. Therefore, mixing can be inferred by measuring the acid at the vapor space of a tank downstream of the injection point: the higher the acid measured, the worse the mixing would be.

An inventive mixing system may comprise a combination of two or more embodiments as described herein.

Experimental

General Information

The extensional flow mixer (EFM) in all the studies described below is of the design shown in FIG. 1, with two compression region lobes and two extension region lobes. See also, the EFM element in FIG. 31.

Computational Fluid Dynamics (CFD; FLUENT software by Fluent Inc., version 6.3, 2006) is used in some of the studies below to simulate a typical case of the additives injection using the following conditions: the two liquid streams (bulk flow and additive flow) are modeled as two different species in a single-fluid-phase system. The viscosity at each node is taken as the third-power law average: $\mu^{1/3}=x_1\mu_1^{1/3}+x_2\mu_2^{1/3}$, where $x_1$ and $x_2$ refer to the mass fractions of the two streams, and $\mu_1$ and $\mu_2$ refer to the viscosities of the two streams. The mass fractions and the viscosities are inputted into the software program and are based on desired cases. A "pressure outlet" boundary condition is chosen for the outlet of the flow conductor and set at atmospheric. "Mass flow inlet" boundary conditions are chosen for both the inlet boundaries (bulk and additive streams). The additive stream is defined by setting the mass fraction value of that stream to be "one" at the side stream inlet. Hybrid computational grids are constructed consisting of an unstructured mesh for both the extensional flow mixer and the high-shear, high pressure type static mixing elements, and a structured mesh is constructed for the helical type static mixing elements. The approximate grid size for the full geometry (one extensional flow mixer and 23 static mixing elements) is approximately up to 10 million nodes.

The degree of mixing is estimated using the coefficient of variance in each case. The coefficient of variance is determined using the relative deviation of the local concentration from the average concentration at an axial plane at the end of each mixing element. Therefore, the lower the value of the coefficient of variance, the better the degree of mixing.

Coefficient of Variation definition: the CoV is determined using the relative deviation of the local concentration from the average concentration as expressed in Equation 1 below.

$$CoV = \frac{|C - C_{avg}|}{C_{avg}}. \quad \text{(Eqn. 1)}$$

Here, C is the local concentration of the additive stream, and Cavg is the average concentration along an axial plane in the mixer. The average concentration is calculated assuming perfect mixing of the two streams. Once the local CoV is calculated on each node on an axial plane, the average CoV for that plane is calculated as the mass weighted average for that axial plane. A low value of CoV implies that the mixture is highly homogeneous.

Pressure drop (as discussed in this section) is the difference in pressure from the inlet of the injection, just upstream of the extensional flow mixer, to the final exit of the last mixing element in each mixing system, as described below.

Study 1—Acid Measurement

Figure 31:
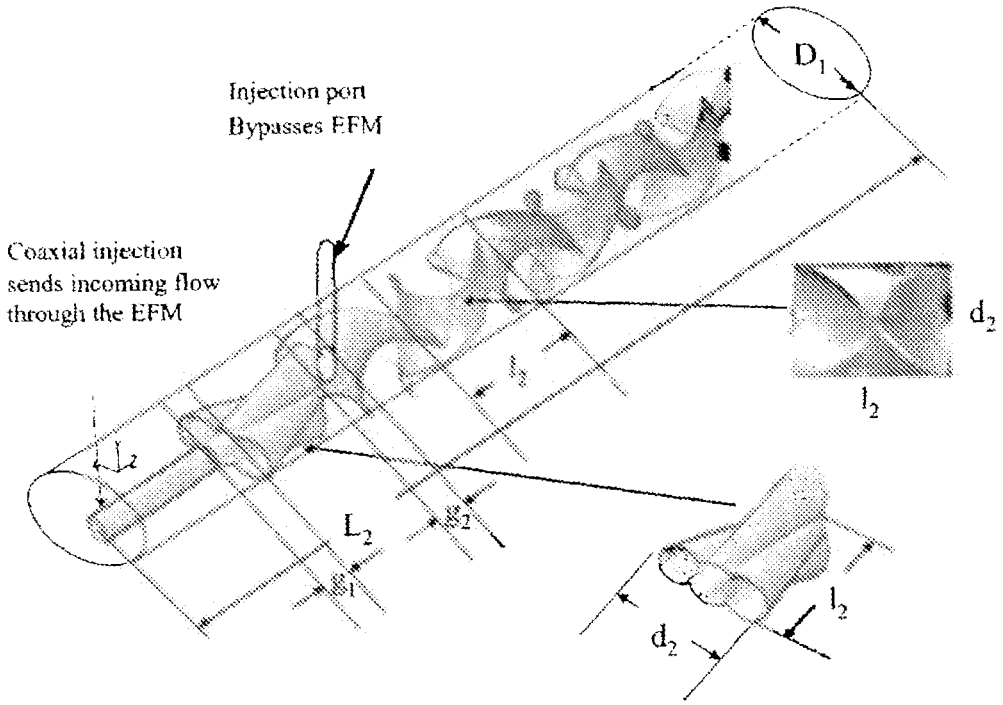
FIG. 31 depicts the mixing system comprising a coaxial injection with the direction of the bulk flow, a gap, $g_1$, the extensional flow mixer, a gap, $g_2$ wherein another injector perpendicular to the bulk flow direction is into the middle of the flow conductor and with the tip of the injector cut at 45° angle, and six helical type mixing elements (for example Kenics static mixing elements by Chemineer, Inc. of diameter, $d_2$, and length, $l_2$,) inside a flow conductor of internal diameter $D_1$ and length $L_1$.

The mixing system consists of a 2-inch flow conductor (pipe with 1.94" internal diameter) with an extensional flow mixer with two lobes (see FIG. 1), and with the additive being injected coaxially in the middle of the extensional flow mixer (EFM) using a half-inch pipe. Downstream of the mixer is another injector (pipe) placed perpendicular to the main flow, with a quarter inch to half-inch diameter pipe placed so that the tip of the pipe is in the middle of the main flow, and the tip is cut at 45° and placed at a distance of one inch from the extensional flow mixer. Downstream of this injector are 12 helical type static mixing elements (see FIG. 31). FIG. 31 shows the coaxial injector; a 2-inch gap ($g_1$); the EFM ($l_2$=1.94 inches, $d_2$=1.94 inches); the gap, $g_2$, of 1.0 $D_1$ between the EFM and the first helical static mixing element; another injector perpendicular to the main flow placed within that gap, $g_2$; and six of the 12 helical mixing elements. Each helical type mixing element has the same dimensions as the others ($l_2$=2.90 inches, $d_2$=1.94 inches). The flow conductor has a $L_1/D_1$=21.

Figure 23:
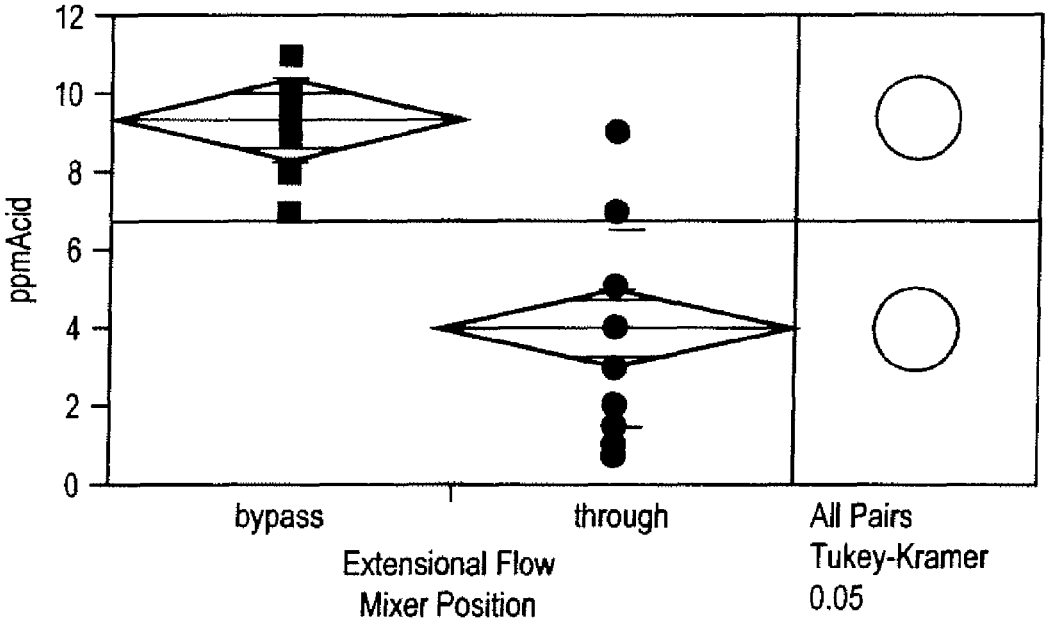
FIG. 23 is of statistical analysis of acid concentration in the vapor space of a vessel in parts per million volume for the invention and a comparison.

Injection is performed so that the acid neutralizing agent enters the process either upstream (coaxial injection) or downstream (injection port bypass), while the system is running at steady-state conditions. A set of readings (see GASTEC probe below) is taken, and the injection is switched to the alternate position. After sufficient time is allowed for the system to reach a new steady-state, another set of readings is taken, and the process is repeated for approximately one month. The readings are compared using JMP statistical analysis software, version 8 (JMP is version 8 statistical software package from SAS corporation), for their means and standard deviations. The results are shown in FIG. 23, and the Tukey-Kramer pairs comparison are shown in Table 1. The Tukey-Kramer method compares mean values of unequal sample size. The mean values of the acid measurements are approximately 9 and 4 parts per million volume, respectively, for the cases where injection is performed downstream and upstream of the extensional flow mixer.

All the methods for measuring the acid involve the use of GASTEC No. 14L detector tubes, with a GASTEC GV-1000 manual gas sampling pump. The sampling procedure is as follows: gas from the vapor stream of the downstream tank is collected in 1 or 3 liter TEDLAR gas bags, via a tubing connection, after the line is purged. The tube is hooked to the sample bag on one end and to the pump on the other end. One test gas sample is drawn into the tube using a syringe-type action (pump), as the bag is inflated, and another test gas sample is drawn within 10 to 15 minutes from obtaining the first sample. The changing color of the detector indicates the "parts per million volume" level of hydrochloric acid (HCl) in the stream. The average of the two readings, which are nearly identical in all cases, is recorded.

As seen in Table 1, lower acid levels were observed when the acid neutralizing agent entered the extensional flow mixer via the coaxial injection port.

TABLE 1

Means and standard deviations

| Level | Number | Mean | Std Dev | Std Err Mean | Lower 95% | Upper 95% |
|---|---|---|---|---|---|---|
| bypass | 16 | 9.32500 | 1.05736 | 0.26434 | 8.7616 | 9.8884 |
| through | 15 | 4.01133 | 2.55423 | 0.65950 | 2.5969 | 5.4258 |

Study 2—Degree of Mixing

A typical simulation (using the software and techniques described above in the General Information section) comprises the following: a) a mixing system containing one injector perpendicular to the main flow with a quarter inch to half-inch diameter pipe placed so that the tip of the pipe is in the middle of the main flow, and the tip is cut at 45°; followed by 0.5 $D_1$ gap; followed by twelve helical type static mixer elements (each having $l_2$=0.6858 m, $d_2$=0.4572 m); and no extensional flow mixer; and b) a mixing system containing one coaxial injector; followed by a 0.4 $D_1$ gap, $g_1$; one extensional mixer ($l_2$=0.4572 m, $d_2$=0.4572 m); followed by a 1.0 $D_1$ gap, $g_2$, followed by twelve helical type static mixer elements (each having $l_2$=0.6858 m, $d_2$=0.4572 m). The density of the two streams is taken to be 741 kg/m$^3$, and both mixing configurations are enclosed in a flow conductor of $D_1$=0.4572 m.

Figure 24:
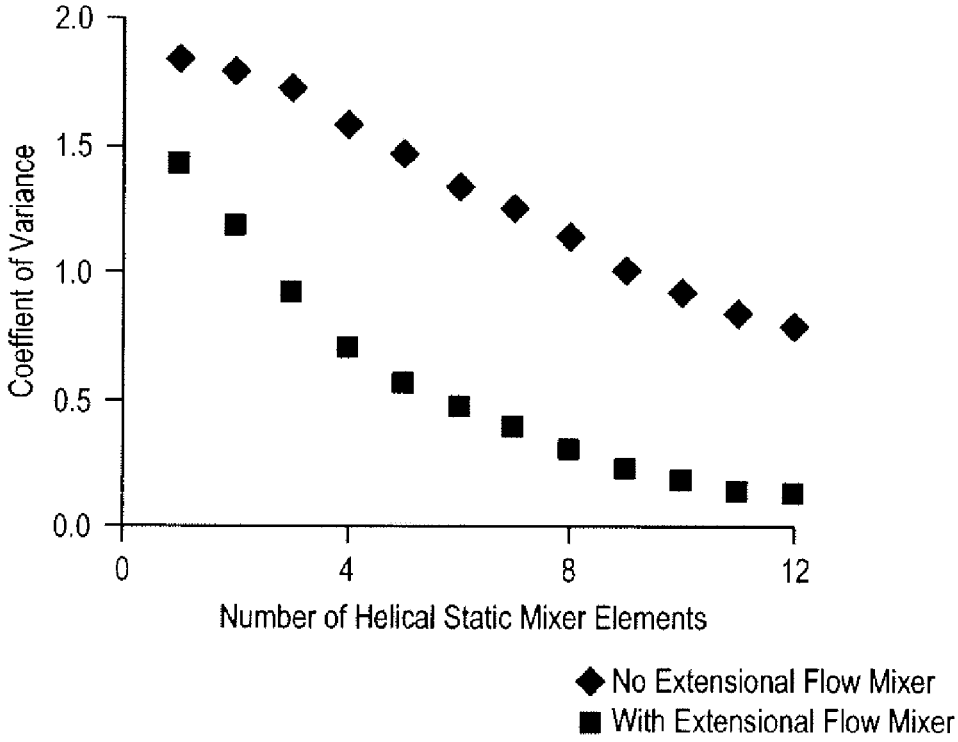
FIG. 24 is simulated coefficient of variance for the invention and a comparison.

The results from the simulations are summarized in FIG. 24, where the coefficient of variance is plotted against the number of helical type mixing elements. The simulations predict that the coefficient of variance would drop from 0.80 to 0.15 with the addition of the extensional flow mixer upstream of the helical static mixers.

Study 3—Degree of Mixing/Minimal Energy

Figure 25:
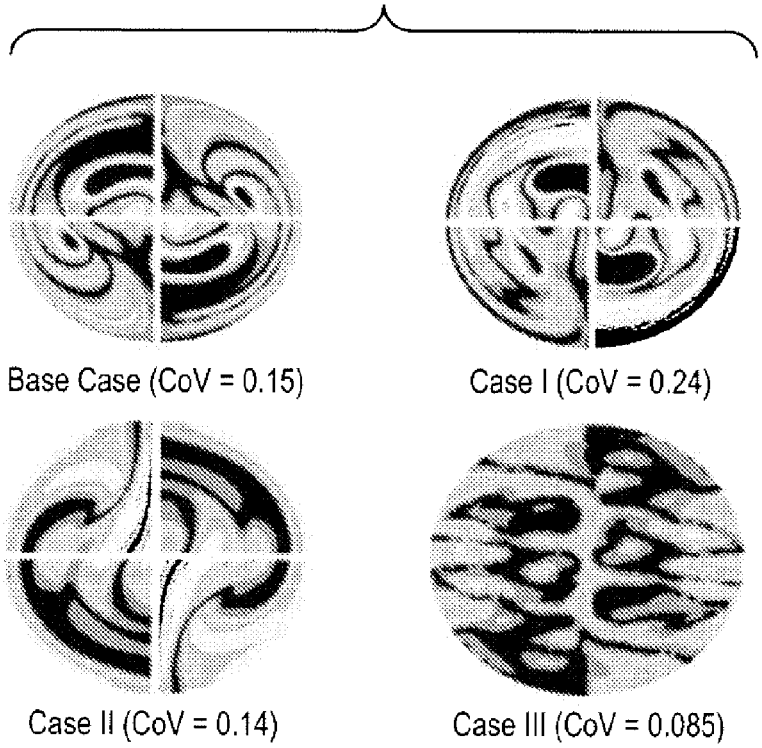
FIG. 25 is simulated coefficient of variance for profiles along the conductor length for the inventions and a base comparison.

Computational Fluid Dynamics (as discussed above) is used to simulate various cases in an attempt to obtain improved mixing with the minimal energy requirement in the form of pressure drop. Four cases, as shown as examples in FIG. 25, compare the final coefficient of variance at the exit of a mixing system that includes a coaxial injection into an extensional flow mixer followed by a series of various static mixers. Each configuration is chosen so that the overall pressure drop is approximately the same in all cases. In all cases, the flow conductor diameter, $D_1$, is 9.75 inches and the injector stream enters via a 0.48 inch pipe. The bulk flow is 149,000 kg/hr and the additive flow is 750 kg/hr. The viscosity of the bulk stream is 6,000 cp and the viscosity of the additive stream is 1 cp.

The base case is as follows: a coaxial injector pipe of 0.48 inches in diameter, followed by a 0.4 $D_1$ gap ($g_1$), followed by an extensional flow mixer ($d_2$=9.75 inches, $l_2$=9.75 inches), followed by a 1.0 $D_1$ gap ($g_2$), followed by twelve helical type static mixing elements (each element $d_2$=9.75 inches, $l_2$=14.625 inches).

Case I is as follows: a coaxial injector pipe of 0.48 inches in diameter, followed by a 0.4 $D_1$ gap ($g_1$), followed by an extensional flow mixer ($d_2$=9.75 inches, $l_2$=9.75 inches), followed by a 1.0 $D_1$ gap ($g_2$), followed by one high-shear, high-pressure drop static mixing element consisting of an array of crossed bars arranged at an angle of 45° against the tube axis (such as SMX, $d_2$=9.75 inches, $l_2$=9.75 inches), followed by 0.5 $D_1$ gap, followed by six helical type static mixing elements (each element $d_2$=9.75 inches, $l_2$=14.625 inches).

Case II is as follows: a coaxial injector pipe of 0.48 inches in diameter, followed by a 0.4 $D_1$ gap ($g_1$), followed by an extensional flow mixer ($d_2$=9.75 inches, $l_2$=9.75 inches), followed by a 1.0 $D_1$ gap ($g_2$), followed by four helical type static mixing elements (each element $d_2$=9.75 inches, $l_2$=14.625 inches), followed by a 1.0 $D_1$ gap, followed by one high-shear, high-pressure drop static mixing element (such as SMX, $d_2$=9.75 inches, $l_2$=9.75 inches), followed by 1.0 $D_1$ gap, followed by two helical type static mixing elements (each element $d_2$=9.75 inches, $l_2$=14.625 inches).

Case III is as follows: a coaxial injector pipe of 0.48 inches in diameter, followed by a 0.4 $D_1$ gap ($g_1$), followed by an extensional flow mixer ($d_2$=9.75 inches, $l_2$=9.75 inches), followed by a 1.0 $D_1$ gap ($g_2$), followed by six helical type static mixing elements (each element $d_2$=9.75 inches, $l_2$=14.625 inches), followed by a 1.0 $D_1$ gap, followed by one high-shear, high-pressure drop static mixing element (such as SMX, $d_2$=9.75 inches, $l_2$=9.75 inches.

The base case (see FIG. 25) has an estimated coefficient of variance (see Eqn. 1) of 0.15. Case I has an estimated coefficient of variance of 0.24. Case II has an estimated coefficient of variance of 0.14. Case III has an estimated coefficient of variance of 0.085. Since all these cases have very similar pressure drops, the configuration shown in Case III is most desirable for mixing these streams.

Study 4—Degree of Mixing/Simulations with Different Mixing System Configurations/Blending of Two Resins Another application of the mixing system is in blending resins of different viscosities. The resin that is added as a smaller stream into the resin of the main flow can be either more or less viscous than the main flow resin, or even have the same viscosity as the main flow resin. Computational Fluid Dynamics (see above) simulations indicate that the mixing system comprising a coaxial injection through the extensional flow mixer, followed by helical type mixing elements, followed by additional high-shear, high-pressure drop mixing elements (consisting of an array of crossed bars arranged at an angle of 45° against the tube axis) is superior to using a tangential type injection upstream of helical type mixing elements, when the two systems were compared at similar energy requirements in the form of pressure drop. The internal diameter of the flow conductor is $D_1$=9.75 inches and the additive injection has a diameter of 0.48 inches. The extensional flow mixer has a diameter of 9.75 inches and length of 9.75 inches. Each helical type static mixing element is the same with $d_2$=9.75 inches and $l_2$=14.625 inches. Each high-shear, high-pressure drop mixing element (consisting of an array of crossed bars arranged at an angle of 45° against the tube axis) has $d_2$=9.75 inches and $l_2$=9.75 inches. In addition, mixing is expected to be better if the mixing system comprises a coaxial injection upstream of the extensional flow mixer, followed by a one pipe diameter gap, followed by helical type mixing elements, as compared to a system comprising coaxial injection upstream of the extensional flow mixer, followed by a one pipe diameter gap, followed by high-shear, high-pressure drop mixing elements (consisting of an array of crossed bars arranged at an angle of 45° against the tube axis) if the two mixing systems are compared at the same pressure drop requirements.

Figures 26A, 26B, 26C:
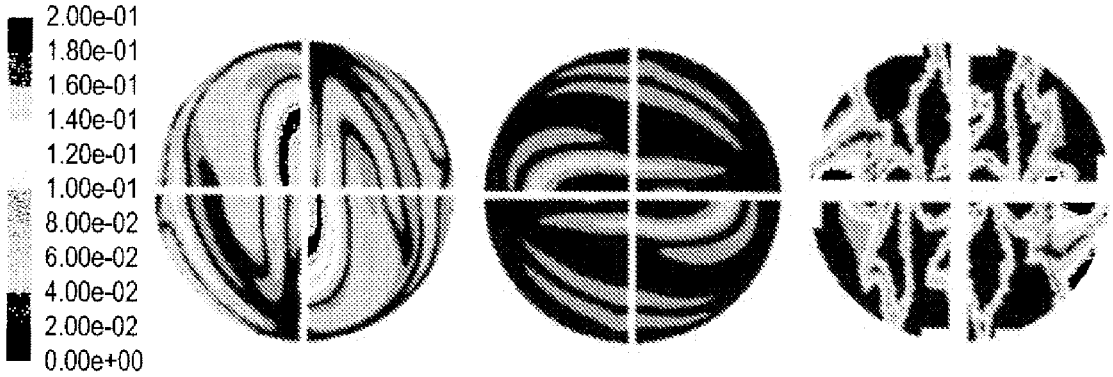
FIGS. 26 (*a*), (*b*), and (*c*) are simulated coefficient of variance for profiles along the conductor length for the invention and a base comparison.

FIG. 26 presents the coefficient of variance (as defined in Eqn. 1) for the blending of two resins, with the main flow resin having a viscosity of approximately 30,500 poise, and the side stream resin having a viscosity of approximately 20,000 poise. The flow ratio of the side stream to the main stream is 8.3 in terms of mass. Three cases are compared in FIG. 26, all showing the degree of mixing at the same pressure drop, and the coefficient of variance is shown at the end of each mixing system.

Case (a), in FIG. 26, comprises a mixing system consisting of an injection perpendicular to the bulk flow with a pipe that does not protrude into the bulk flow, followed by a 0.5 D1 gap, followed by 14 helical type mixing elements and exhibits a coefficient of variance of 0.047. Case (b), in FIG. 26, comprises a coaxial injection followed by a 2-inch gap ($g_1$) upstream of an extensional flow mixer ($d_2$=9.75 inches and $l_2$=9.75 inches), followed by one pipe diameter gap (1.0 $D_1$, $g_2$), followed by thirteen helical type mixing elements (each element having $d_2$=9.75 inches and $l_2$=14.625 inches). Case (b) has a coefficient of variance of 0.017. Case (c), in FIG. 26, comprises a mixing system consisting of a coaxial injection followed by a 2-inch gap ($g_1$), followed by a 2-inch gap ($g_1$) upstream of an extensional flow mixer ($d_2$=9.75 inches and $l_2$=9.75 inches) followed by one pipe diameter gap (1.0 $D_1$, $g_2$), followed by two high-shear, high-pressure drop mixing elements (consisting of an array of crossed bars arranged at an angle of 45° against the tube axis (SMX type mixing elements, each element having $d_2$=9.75 inches and $l_2$=9.75 inches, the second element rotated 90 degrees with respect to the first element)). Case (c) has a coefficient of variance of 0.23.

These simulations show that a coaxial injection upstream of the extensional flow mixer improves mixing when that setup is placed upstream of helical type mixing elements, with the number of helical type mixing elements adjusted, so that the two mixing systems exhibit approximately the same pressure drop. In addition, high-shear, high-pressure drop mixing elements consisting of an array of crossed bars, arranged at an angle of 45° against the tube axis, are not as efficient in mixing resins of different viscosities as are helical type mixing elements when they are compared at similar pressure drops.

Study 5—Degree of Mixing/Resins of Different Viscosities/Simulations

Another set of simulations is performed comparing a case of blending two resins with a bulk stream viscosity of 5,000 poise and a small stream viscosity of 20,000 poise, and the amount of small stream entering at 7.5 weight percent of the total flow. Two cases are compared for degree of mixing, and the simulations are shown in FIG. 27.

Figures 27A, 27B:
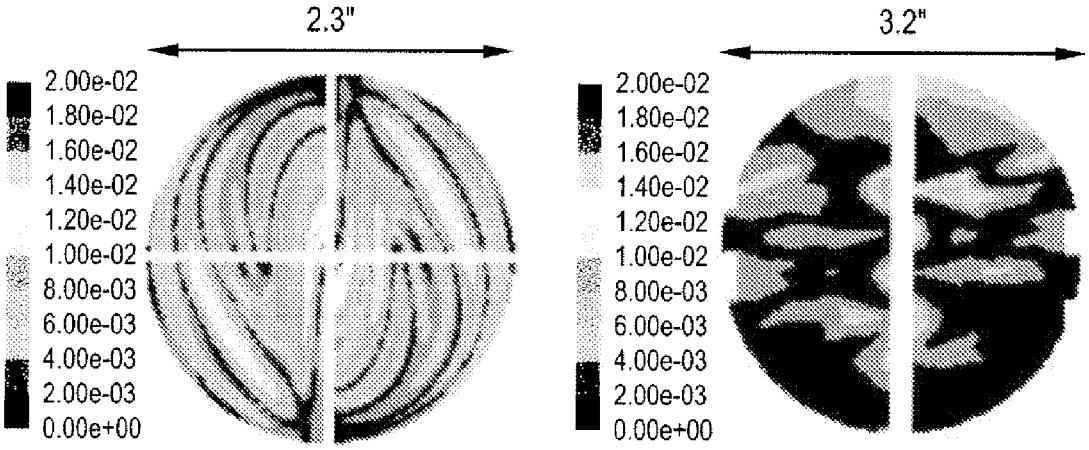
FIGS. 27 (*a*) and (*b*) are simulated coefficient of variance for profiles along the conductor length for the inventions.

Case (a), in FIG. 27, comprises a mixing system that includes a coaxial injection of a 0.25 inch pipe into a flow conductor of 2.3 inches in internal diameter, $D_1$. The coaxial injection is followed by a 1-inch gap ($g_1$) upstream of the extensional flow mixer ($d_2$=2.3 inches, $l_2$=2.3 inches), followed by a 1.0 $D_1$ gap, then followed by eighteen helical type mixing elements ($d_2$=2.3 inches, $l_2$=3.0 inches), all into a conductor of 2.3 inches inside diameter, $D_1$.

Case (b), in FIG. 27, comprises a mixing system that includes a coaxial injection a 0.25 inch pipe into a flow conductor of 2.3 inches in internal diameter, $D_1$. The coaxial injection is followed by a 1-inch gap ($g_1$) upstream of the extensional flow mixer ($d_2$=2.3 inches, $l_2$=2.3 inches), followed by a 1.0 $D_1$ gap, then followed by nine helical type mixing elements ($d_2$=2.3 inches, $l_2$=3.0 inches), all into a conductor of 2.3 inches inside diameter; a diameter adaptor to increase the conductor diameter from 2.3 to 3.2 inches inside diameter, followed by three high-shear, high-pressure drop mixing elements consisting of an array of crossed bars arranged at an angle of 45° against the tube axis (SMX type element, each at $d_2$=3.2 inches, $l_2$=3.2 inches, each rotated 90 degrees with respect to the previous element and all inside the 3.2 inch conductor).

Case (a) in FIG. 27 has a coefficient of variance (as defined in Eqn. 1) of 0.0063 at the end of the mixing system, and an estimated pressure drop of 91 pounds force per square inch. Case (b) in FIG. 27 has a coefficient of variance of 0.0019 at the end of the mixing system, and an estimated pressure drop of 80 pounds force per square inch.

Study 6—Degree of Mixing/Resins of Different Viscosities/Laboratory Experiments

The simulations shown in Study 5 above are also tested with the same setup as described above in a laboratory setup. The polymer is taken through an underwater pelletizer and the resulting polymer pellets are tested using various analytical techniques. At the end of the mixing setup there is a diverter valve that is opened, and the polymer is allowed to flow out of the system as a continuous cylindrical "rope." For flow visualization purposes, approximately twenty weight percent of the pellets in the additive injection stream are replaced with pellets that are compounded with one weight percent carbon black. Therefore, as the two streams are blended, one can observe the striations, and estimate the extent of mixing. One way to observe the mixing is to obtain a thin sliver of the polymer cylindrical "rope" cut perpendicular to the axial direction and cut along the axis of the pipe, and examine the sample under a light.

Figure 28A:
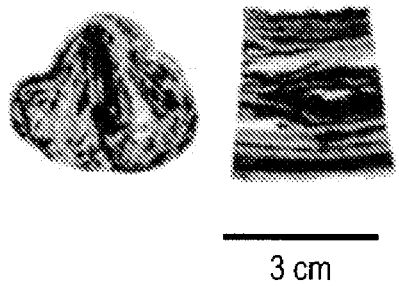
FIGS. 28 (*a*), (*b*), and (*c*) are photographs of blends of resins where the secondary stream is black and the primary stream is white along the axis of the conductor at the end of the mixing system for the inventions and a base comparison.
Figure 28B:
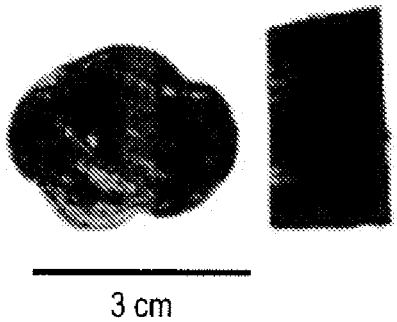
Figure 28C:
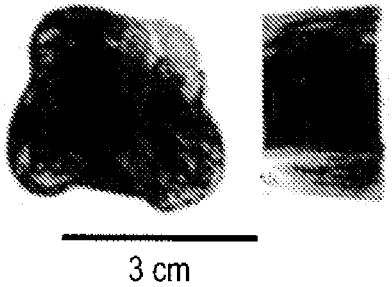

FIG. 28 compares three cases for the same physical properties and flow rates described in Study 5 above, and three configurations. Case (a) comprises a mixing system that includes an injection of a 0.25 inch pipe perpendicular into the direction of the flow, but not protruding into the bulk flow conductor of 2.3 inches in internal diameter, $D_1$. The perpendicular injection is followed by a 1-inch gap ($g_1$) upstream of the extensional flow mixer ($d_2$=2.3 inches, $l_2$=2.3 inches), followed by a 1.0 $D_1$ gap, then followed by eighteen helical type mixing elements ($d_2$=2.3 inches, $l_2$=3.0 inches), all into a conductor of 2.3 inches inside diameter.

Case (b) is exactly the same mixing configuration as in Case (a) of FIG. 27. Case (c) is exactly the same mixing configuration as Case (b) of FIG. 27. FIG. 28 shows the axial and longitudinal striations representing the degree of mixing for the three cases described above. In FIG. 28, the domains that contain either the black material (secondary stream) or the white material (primary stream) are smaller for Case (b) as compared to Case (a). In addition, those domains are more evenly distributed along the whole diameter of the conductor for Case (c) as compared to Case (b). Case (c) in FIG. 28 offers marginal improvement over Case (b). The estimated pressure drop for Case (a) in FIG. 28 is 86.5 pounds force per square inch, and for Case (b) in FIG. 28 the pressure drop is estimated at 91 pounds force per square inch. The pressure drop for Case (c) in FIG. 28 is estimated at 80 pounds force per square inch.

Study 7—Simulations of Different Mixing Configurations

The following study presents simulations of five mixing configurations with the physical properties and operating conditions shown in Table 2, and uses the software and techniques described above. The additive viscosity is simulated using the following equation:

$$\eta = \eta_\infty + (\eta_0 - \eta_\infty)\cdot[1 + (\dot{\gamma}\cdot\lambda)^2]^{\frac{(n-1)}{2}},$$

with $\lambda$=47.965 (s); n=0.5624; $\gamma$=shear rate ($s^{-1}$), calculated in the code; $\eta_0$=38873.4; $\eta_\infty$=1.

Comparative Configuration A comprises a mixing system that includes an injection of a 2-inch pipe perpendicular into the direction of the flow and placed so that the tip of the pipe is in the middle of the main flow, and the tip is cut at 45°, inside a flow conductor of 23 inches in internal diameter, $D_1$; followed by 0.5 $D_1$ gap; followed by 18 helical type static mixing elements (each element having $d_2$=23 inches and $l_2$=17.7 inches); all inside the flow conductor of internal diameter $D_1$.

Comparative Configuration B comprises a mixing system that includes an injection of a 2-inch pipe perpendicular into the direction of the flow and placed so that the tip of the pipe is in the middle of the main flow, and the tip is cut at 45°, inside a flow conductor of 23 inches in internal diameter, $D_1$; followed by 0.5 $D_1$ gap; followed by 23 helical type static mixing elements (each element having $d_2$=23 inches and $l_2$=17.7 inches); all inside the flow conductor of internal diameter $D_1$.

Inventive Configuration (1) comprises a mixing system that includes a coaxial injection of a 2-inch pipe with the direction of the flow and having a length into the flow of 4 inches, and placed inside a flow conductor of 23 inches in internal diameter, $D_1$; followed by 0.5 $D_1$ gap; followed by an extensional flow mixer (d=23 inches, $l_2$=23 inches); followed by a 1.0 $D_1$ gap; followed by 18 helical type static mixing elements (each element having $d_2$=23 inches and $l_2$=17.7 inches); all inside the flow conductor of internal diameter $D_1$.

Comparative Configuration C comprises a mixing system that includes an injection of a 1-inch pipe perpendicular into the direction of the flow, and placed so that the tip of the pipe is in the middle of the main flow, and the tip is cut at 45° inside a flow conductor of 9 inches in internal diameter, $D_1$; followed by 0.5 $D_1$ gap; followed by 18 helical type static mixing elements (each element having $d_2$=9 inches and $l_2$=13.5 inches); all inside the flow conductor of internal diameter $D_1$.

Comparative Configuration D comprises a mixing system that includes an injection of a 1-inch pipe perpendicular into the direction of the flow and placed so that the tip of the pipe is in the middle of the main flow, and the tip is cut at 45°, inside a flow conductor of 9 inches in internal diameter, $D_1$; followed by 0.5 $D_1$ gap; followed by 18 helical type static mixing elements (each element having $d_2$=9 inches and $l_2$=6.9 inches); all inside the flow conductor of internal diameter $D_1$.

The coefficient of variance, CoV, (as defined in Eqn. 1) at the exit of the mixing system is used to determine the degree of mixing in the different configurations. Comparative configuration A has highest CoV indicating it has the poorest mixing. The simulations show that Inventive Configuration 1 is superior to Comparative Configurations A or B, even though Comparative Configuration B comprises more static mixing elements than Inventive Configuration 1. In addition, better mixing is achieved with only a slightly higher pressure drop than Comparative Configuration A and much less than Comparative Configuration B. Comparative Configurations C and D indicate that the degree of mixing is better than a configuration having the same physical properties and flow conditions, but with either a flow conductor having a larger diameter or mixing elements having lower $l_2/d_2$. Inventive Configuration 1 shows better mixing than all the comparative cases, even though Inventive Configuration 1 has a larger flow conductor diameter than comparative configuration D, and a lower $l_2/d_2$ than Comparative Configuration C.

TABLE 2

Comparison of four comparative mixing systems and an inventive mixing system for the same flow rates and physical properties, but with different configurations.

| | Comparative configuration A | Comparative configuration B | Inventive configuration 1 | Comparative configuration C | Comparative configuration D |
|---|---|---|---|---|---|
| Bulk flow viscosity (poise) | 6,820 | 6,820 | 6,820 | 6,450 | 6,450 |
| Bulk flow rate (kg/s) | 9.7 | 9.7 | 9.7 | 1.5 | 1.5 |
| Densities (kg/m$^3$) | 760 | 760 | 760 | 760 | 760 |
| Flow ratio, additive to bulk | 12.5 | 12.5 | 12.5 | 12.5 | 12.5 |
| Additive flow % of total | 7.4% | 7.4% | 7.4% | 7.4% | 7.4% |
| Element $l_2/d_2$ | 0.77 | 0.77 | 0.77 | 1.5 | 0.77 |
| Flow conductor $L_1/D_1$ | 14.9 | 18.7 | 16.9 | 28.0 | 14.9 |
| Pressure drop (psi) | 81 | 103 | 89 | 210 | 157 |
| CoV at end of mixer | 1.11 | 0.79 | 0.48 | 0.63 | 0.74 |

Study 8—Acid Measurements with Two Different Mixing Configurations

Acid measurements are made using the same experimental technique, equipment, and equivalent location as in Study 1 above. The flow conductor is a 10-inch flow conductor (9.3 inches internal diameter); the additive injector size is a 1-inch pipe; the bulk flow is approximately 48 kg/s; the additive flow is approximately 0.20 kg/s; the density of the two streams is approximately 780 kg/m$^3$; the viscosity of bulk flow ranges from less than 1,000 to approximately 6,000 cp; the viscosity of the additive stream is approximately 1 cp.

Comparative Configuration E: additive injector perpendicular to bulk flow, and placed so that the tip of the pipe is in the middle of the bulk flow conductor, and the tip is cut at 45°; followed by 0.4 $D_1$ gap; followed by six helical type static mixer elements (all the same having $d_2$ of 9.3 inches and $l_2$ of 14.625 inches); followed by 1 $D_1$ gap; followed by six helical type static mixer elements (all the same having $d_2$ of 9.3 inches and $l_2$ of 14.625 inches).

Inventive Configuration 2: additive injector coaxial to the bulk flow with a 4-inch length in line with the flow; followed by 0.2 $D_1$ gap, $g_1$; followed by an EFM ($d_2$=9.3 inches and $l_2$=9.3 inches); followed by 1 $D_1$ gap, $g_2$; followed by 13 helical type static mixer elements (all the same having $d_2$ of 9.3 inches and $l_2$ of 12.1 inches), with the leading edge of the first helical element placed perpendicular to the main axis (major axis) of the exit of the EFM.

Figure 32:
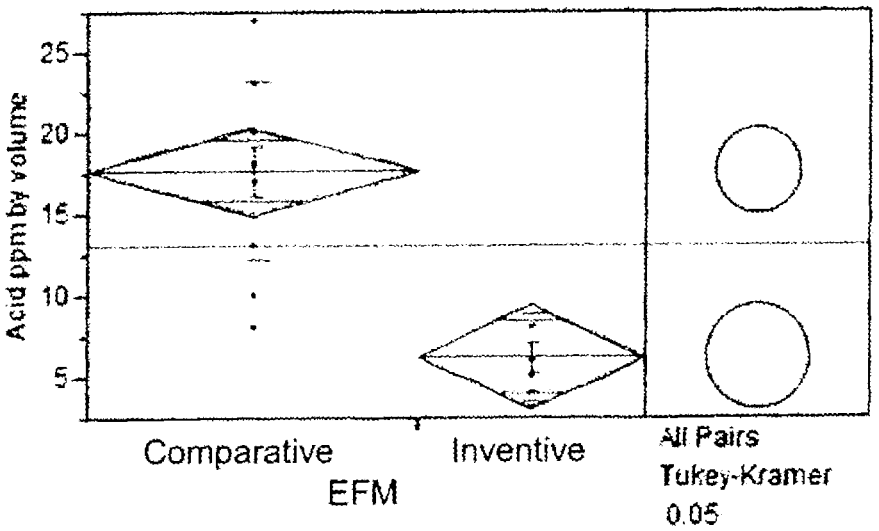
FIG. 32 depicts statistical analysis results using JMP software for the Tukey-Kramer test for the means of acid measurements using two different mixing system configurations.

FIG. 32 shows the acid measurements for the two cases (Comparative E and Inventive 2), as depicted using JMP software (defined above) and the Tukey-Kramer test. The Tukey-Kramer test shows that the mean values of the acid measurements in the comparative and inventive configurations are significantly different, with 95% confidence interval. Table 3 below shows the details on the mean values and standard deviations for these configurations. For Inventive Configuration 2, the mean value is reduced by approximately 65%, as compared to Comparative Configuration E, and the standard deviation is reduced by approximately 50% in Inventive Configuration 2, as compared to Comparative Configuration E. These results indicate that Inventive Configuration 2 is superior in mixing the two streams as compared to Comparative Configuration E.

TABLE 3

Means and standard deviations

| Level | Number | Mean | Std Dev | Std Err Mean | Lower 95% | Upper 95% |
|---|---|---|---|---|---|---|
| Comparative E | 13 | 17.6923 | 5.4526 | 1.5123 | 14.397 | 20.987 |
| Inventive 2 | 9 | 6.2222 | 2.7285 | 0.9095 | 4.125 | 8.319 |

Study 9—Simulations of Different Mixing Configurations for Additive Injection

The following study presents simulations of eight cases for six mixing configurations using the physical properties and operating conditions shown in Table 4, using the software and techniques described above. There are two comparative configurations and four inventive configurations. For all cases, the flow conductor is a 10-inch pipe (internal diameter of 9.3 inches) and the injector is a 1-inch pipe. The bulk and additive flow rates are shown in Table 4. The viscosity of the bulk stream is shown in Table 4, and the viscosity of the additive stream is taken to be 1 cp.

Comparative Configuration F is as follows: additive injector perpendicular to bulk flow, placed so that the tip of the pipe is in the middle of the bulk flow conductor, and the tip is cut at 45°; followed by 0.4 $D_1$ gap; followed by nine helical type static mixer elements (all the same having $d_2$ of 9.3 inches and $l_2$ of 14.625 inches); all in a flow conductor having $L_1/D_1$ of 14.0.

Comparative Configuration G is as follows: additive injector perpendicular to bulk flow, placed so that the tip of the pipe is in the middle of the bulk flow conductor, and the tip is cut at 45°; followed by 0.4 $D_1$ gap; followed by 12 helical type static mixer elements (all the same having $d_2$ of 9.3 inches and $l_2$ of 14.625 inches); all in a flow conductor having $L_1/D_1$ of 18.5.

Inventive Configuration 3: additive injector coaxial to the bulk flow with a 4-inch length in line with the flow; followed by 0.2 $D_1$ gap, $g_1$; followed by an EFM ($d_2$=9.3 inches and $l_2$=9.3 inches); followed by 1 $D_1$ gap, $g_2$; followed by eight helical type static mixer elements (all the same having $d_2$ of 9.3 inches and $l_2$ of 11.2 inches), with the leading edge of the first helical element placed perpendicular to the main axis (major axis) of the exit port of the EFM; all in a flow conductor having $L_1/D_1$ of 11.0.

Inventive Configuration 4: additive injector coaxial to the bulk flow, and has a 4-inch length in line with the flow; followed by 0.2 $D_1$ gap, $g_1$; followed by an EFM ($d_2$=9.3 inches and $l_2$=9.3 inches); followed by 1 $D_1$ gap, $g_2$; followed by 13 helical type static mixer elements (all the same having $d_2$ of 9.3 inches and $l_2$ of 11.2 inches), with the leading edge of the first helical element placed perpendicular to the main axis (major axis) of the exit port of the EFM; all in a flow conductor having $L_1/D_1$ of 17.0.

Inventive Configuration 5: additive injector coaxial to the bulk flow, and has a 4-inch length in line with the flow; followed by 0.2 $D_1$ gap, $g_1$; followed by an EFM ($d_2$=9.3 inches and $l_2$=9.3 inches); followed by 1 $D_1$ gap, $g_2$; followed by 18 helical type static mixer elements (all the same having $d_2$ of 9.3 inches and $l_2$ of 11.2 inches), with the leading edge of the first helical element placed perpendicular to the main axis (major axis) of the exit port of the EFM; all in a flow conductor having $L_1/D_1$ of 23.0.

Inventive Configuration 6: additive injector coaxial to the bulk flow, and had a 4-inch length in line with the flow; followed by 0.2 $D_1$ gap, $g_1$; followed by an EFM ($d_2$=9.3 inches and $l_2$=9.3 inches); followed by 1 $D_1$ gap, $g_2$; followed by 11 helical type static mixer elements (all the same having $d_2$ of 9.3 inches and $l_2$ of 11.2 inches), with the leading edge of the first helical element placed perpendicular to the main axis (major axis) of the exit port of the EFM; all in a flow conductor having $L_1/D_1$ of 17.9.

There are eight cases presented in Table 4 for the five configurations described above. As shown in Table 4, Inventive Configuration 3 shows a much better CoV than Comparative Configuration F, for the same conditions and pressure drop. Inventive Configurations 4 and 5 demonstrate that the degree of mixing can be improved further with minimal increases in pressure drop, as compared to Comparative Configuration F. Inventive Configuration 6 and Inventive Configuration 4 for cases 6 and 7, respectively, demonstrate that they have better degree of mixing than Comparative Configuration G, for lower, or about the same, pressure drop, and the same processing conditions. Inventive Configuration 5 in case 8 demonstrates a much better degree of mixing than Comparative Configuration G for the same processing conditions, with a minimal increase in pressure drop.

TABLE 4

| Case | Configuration | No Mixing elements | Element $l_2/d_2$ | Flow Conduct or $L_1/D_1$ | Solution Viscosity (cp) | CoV | Bulk flow (kg/hr) | Additive flow (kg/hr) | Pressure Drop (psi) |
|---|---|---|---|---|---|---|---|---|---|
| 1 | Comparative F | 9 | 1.5 | 14.0 | 2300 | 0.180 | 175000 | 500 | 11 |
| 2 | Inventive 3 | 8 | 1.2 | 11.0 | 2300 | 0.077 | 175000 | 500 | 11 |
| 3 | Inventive 4 | 13 | 1.2 | 17.0 | 2300 | 0.009 | 175000 | 500 | 19 |
| 4 | Inventive 5 | 18 | 1.2 | 23.0 | 2300 | 0.002 | 175000 | 500 | 23 |
| 5 | Comparative G | 12 | 1.5 | 18.5 | 6000 | 0.380 | 148000 | 625 | 26 |
| 6 | Inventive 6 | 11 | 1.5 | 17.9 | 6000 | 0.280 | 148000 | 625 | 19 |
| 7 | Inventive 4 | 13 | 1.2 | 17.0 | 6000 | 0.213 | 148000 | 625 | 27 |
| 8 | Inventive 5 | 18 | 1.2 | 23.0 | 6000 | 0.097 | 148000 | 625 | 30 |

Although the invention has been described in considerable detail in the preceeding examples, this detail is for the purpose of illustration, and is not to be constructed as a limitation on the invention, as described in the following claims.

The invention claimed is:

1. A mixing system comprising the following:

A) at least one extensional flow mixer comprising:

a generally open and hollow flow mixer body having a contoured outer surface and having:

a single entrance port and a single exit port;

a means for compressing a bulk stream flowing through the generally open and hollow body in a direction of flow, and at least one injected additive stream introduced at the single entrance port in the direction of flow; and a means for broadening the bulk stream and the at least one injected additive stream, such that an interfacial area between the bulk stream and the at least one injected additive stream is increased as the bulk stream and the at least one injected additive stream flow through the generally open and hollow flow mixer body in the direction of flow to promote mixing of the bulk stream and the at least one injected additive stream;

B) a flow conductor having a longitudinal axis and having a the generally open and hollow flow mixer body secured therein; and C) a primary additive stream injector positioned at the entrance port of the generally open and hollow flow mixer body, wherein the primary additive stream injector injects an additive stream into the interior of the flow mixer in the direction of flow, when the bulk stream is flowing through the generally open and hollow flow mixer body, to allow for compression and broadening of the bulk stream and the additive stream together within the extensional flow mixer, to facilitate mixing of the bulk stream and the primary additive stream at an exit of the extensional flow mixer; and wherein the extensional flow mixer is followed by D) a first helical static mixing element that is at least one half "flow conductor diameter ($D_1$)" downstream of the exit port of the extensional flow mixer; and wherein the mixing system comprises at least four helical static mixing elements, placed such that the leading edge of the first helical static mixing element is located perpendicular to a main axis (major axis) of the exit port of the extensional flow mixer.

2. The mixing system of claim 1, wherein the means for compressing and the means for broadening each includes a plurality of contoured lobes, each lobe having a substantially contoured surface, and wherein the plurality of contoured lobes in the means for compressing decrease in size in the direction of flow, and the plurality of contoured lobes in the means for broadening increase in size in the direction of flow.

3. The mixing system of claim 1, wherein the means for compressing lie in a compression plane, and the means for broadening lie in a broadening plane perpendicular to the compression plane.

4. The mixing system of claim 1, wherein the means for compressing decreases in size along the compression plane in the direction of flow, and the means for broadening simultaneously increases in size along the broadening plane in the direction of flow.

5. The mixing system of claim 1, wherein the first helical mixing element is not more than "four flow conductor diameters ($4D_1$)" downstream of the exit port of the extensional flow mixer.

6. The mixing system of claim 1, further comprising of at least one high-shear, high-pressure drop static mixing element, comprising an array of crossed bars arranged at an angle of 45° against the axis, and arranged in such a way, that consecutive mixing elements are rotated by 90° around the axis, and placed downstream of the first helical static mixing element.

7. The mixing system of claim 1, wherein the primary additive stream injector is positioned at the center of the entrance port.

8. The mixing system of claim 1, wherein the primary additive stream injector is positioned along a longitudinal axis of the generally hollow flow mixer body.

9. The mixing system of claim 8, wherein the additive stream injector is further positioned at the center of the single entrance port.

10. The mixing system of claim 1, wherein the bulk stream received by the single entrance port comprises at least one of a polymer and a polymer solution.

11. The mixing system of claim 1, wherein the additive stream received by the single entrance port comprises at least one of a monomer and a monomer solution.

12. The mixing system of claim 11, wherein the additive stream comprises a monomer solution, and wherein the monomer solution is ethylene dissolved in solvent.

13. The mixing system of claim 1, wherein the additive stream received by the single entrance port comprises at least one of an additive or additive in solution.

14. The mixing system of claim 13, wherein the additive stream received by the single entrance port is selected from a group consisting of antioxidants, acid scavengers, catalyst kill agents, and solutions thereof.

15. The mixing system of claim 1, wherein the means for compressing comprises a compression region, which comprises two compression region lobes that meet at a constricted central entrance portion, and the broadening region comprises two broadening region lobes that meet at a constricted central exit portion.

16. The mixing system of claim 1, wherein the first helical static mixing element is located at a distance from "one half the diameter of the flow conductor (½ $D_1$)" to "twice the diameter of the flow conductor (2 $D_1$)" downstream of the exit port of the extensional flow mixer.

17. The mixing system of claim 1, wherein the flow conductor is a cylinder that has a length to diameter ratio ($L_1/D_1$) greater than, or equal to, 7.

18. The mixing system of claim 1, wherein the system comprises at least ten helical static mixing elements, followed by at least one high shear, high pressure drop static mixing element.

19. The mixing system of claim 1, wherein the system comprises at least eight helical static mixing elements, followed by at least one high-shear, high pressure drop static mixing element.

* * * * *